United States Patent [19]

Kuse et al.

[11] Patent Number: 4,980,272

[45] Date of Patent: Dec. 25, 1990

[54] METHOD AND A SOLUTION FOR PROCESSING A PHOTOSENSITIVE SILVER HALIDE COLOR PHOTOGRAPHIC MATERIALS

[75] Inventors: Satoru Kuse, Hino; Shigeharu Koboshi, Sagamihara; Masao Ishikawa, Tama, all of Japan

[73] Assignee: Konica Corporation, Tokyo, Japan

[21] Appl. No.: 378,775

[22] Filed: Jul. 12, 1989

[30] Foreign Application Priority Data

Jul. 15, 1988 [JP] Japan ..... 63-177629
Jul. 15, 1988 [JP] Japan ..... 63-177630

[51] Int. Cl.[5] ..... G03C 7/40

[52] U.S. Cl. ..... 430/372; 430/398; 430/429; 430/432; 430/463; 430/521; 430/963

[58] Field of Search ..... 430/372, 398, 429, 432, 430/463, 521, 963

[56] References Cited

U.S. PATENT DOCUMENTS 4,681,835 7/1987 Ishikawa ..... 430/386
4,746,598 5/1988 Kurematsu et al. ..... 430/372
4,778,743 10/1988 Ishikawa ..... 430/376
4,855,217 8/1989 Kurematsu et al. ..... 430/372

FOREIGN PATENT DOCUMENTS 0186169 2/1986 European Pat. Off. .

*Primary Examiner*—Paul R. Michl
*Assistant Examiner*—Thomas R. Neville
*Attorney, Agent, or Firm*—Finnegan, Henderson, Farabow, Garrett and Dunner

[57] ABSTRACT

A method of processing a photosensitive material with a final processing solution is disclosed. The photosensitive material comprises at least one compound selected from the group consisting of compounds represented by the following Formulas (AI-I), (AI-II), (AI-III), (AI-IV) and (BS-I), a concentration of a soluble iron salt in the final processing solution is at least $5\times10^{-3}$/l and a processing time of the final processing solution is not more than 30 seconds.

Formula (AI-I)

Formula (AI-II)

Formula (AI-III)

Formula (AI-IV)

Formula (BS-I)

22 Claims, No Drawings

METHOD AND A SOLUTION FOR PROCESSING A PHOTOSENSITIVE SILVER HALIDE COLOR PHOTOGRAPHIC MATERIALS

FIELD OF THE INVENTION

The invention relates to a method and liquid for processing a photosensitive silver halide color photographic material (hereinafter referred to as "a photosensitive material"where preferable) and, more particularly, to a photographic processing method and the final treating bath used therein whereby it can be achieved to improve the unexposed white ground property, to suppress the foaming of the stabilizing bath, and to make the rapid processing of photosensitive materials practical.

BACKGROUND OF THE INVENTION

Generally in a procedure for obtaining a color image in a photosensitive material subsequent to imagewise exposure, the color developing step is followed by elimination of metal silver, which has been formed, and then by washing for stabilization or other stabilizing treatment replacing the washing.

For the development of photosensitive materials, it is the present-day practice to process them in an automatic developing machine in a running processing system at a processing laboratory, and for the betterment of service to customers, under demand to process an order from the acceptance from the customer to the return to him within one and the same day. This speediness required for the developing process, with processing of orders within a few hours from the acceptance to the return even in demand nowadays, has made it exigencies of the time to develop an efficient rapid processing technique.

The technique has already reached the following level with respect to the processing procedure, time and temperature of a major photosensitive color paper, i.e., for example, the development of a color printing paper to be finished in 8.5 minutes and at a treating temperature of 33° C. through three steps consisting of color developing (3.5 min.), bleach-fixing (1.5 min.), and washing with water (3.5 min.); this technique as an integrated system is disclosed, in U.S. Pat. No. 3,582,322 and West German OLS Patent No. 2,160,872.

Recently, Eastman Kodak has disclosed a rapid processing method for color paper named "Process RA-4" to finish the processing in 3 minutes (treating temperature: 35° C.) comprising three steps of color developing (45 sec.), bleaching-fixing (45 sec.), and stabilizing (90 sec.).

With such reduction of the processing time, however, the process is attended with deterioration of the white ground property of the unexposed portion in a color paper, which makes it difficult to practice a rapid processing. As a means for overcoming this problem, as referred to in the specification of Japanese Patent Publication Open to Public Inspection (hereinafter referred to as "Japanese Patent O.P.I. Publication") No. 151538/1986, it has been proposed to use a specific dye in a photosensitive material and to treat the material with a stabilizing bath which contains a hardening agent. An investigation relating to this proposition, however, has revealed that the effect expected of the stabilizing bath is unsatisfactory when the treating time is so shortened as to be less than 30 seconds, and furthermore that a surface-active agent which dissolves from the photosensitive material into the stabilizing bath causes the bath to foam so vigorously as not to permit ignoring. Moreover, a photosensitive material placed in such condition is found to be liable to a fault of blueing at the light-exposed area.

SUMMARY OF THE INVENTION

Accordingly, the object of the present invention is to provide firstly a method for procesing photosensitive materials whereby a satisfactory quality can be ensured with respect to the white ground property of the unexposed portion in a color paper even in a rapid processing and the foaming property of the stabilizing bath can be improved without causing blueing at the light-exposed area, and secondly a final processing solution for treating the photosensitive materials in the present processing method.

DETAILED DESCRIPTION OF THE INVENTION

As a means for accomplishing the above-mentioned object, there is provided according to this invention a method for processing a photosensitive material which is characterized in that a phososensitive material subjected to the processing contains at least one of compounds represented by General Formulas (AI-I), (AI-II), (AI-III), (AI-IV), and (BS-I) described hereunder, that soluble iron salts are present in a concentration of at least $5\times10^{-3}$ mol per liter in the final processing solution, and that the time of the treatment with said final solution is not more than 30 seconds.

In accordance with the above-mentioned object, there is provided according to this invention a solution for photographic processing, comprising a final solution for processing a photosensitive material, which is characterized in that said photosensitive material subjected to the treatment contains at least one of compounds represented by said General Formulas (AI-I), (AI-II), (AI-III), (AI-IV), and (BS-I), that the time of the treatment is less than 30 seconds, and that soluble iron salts are present in a concentration of at least $5\times10^{-3}$ mol per liter therein.

General Formula (AI-I)

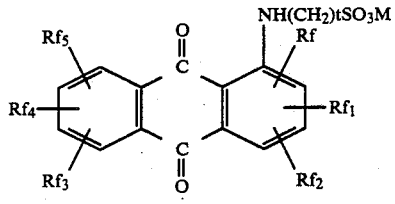

wherein Rf, $Rf_1$, $Rf_2$, $Rf_3$, $Rf_4$, and $Rf_5$ represent each a hydrogen atom, a halogen atom, a hydroxy group, an alkyl group, an alkoxy group, a $-SO_3M$ group, or a $-NHCH_2SO_3M$ group, t an integer of 1 to 3, and M a cation.

General Formula (AI-II)

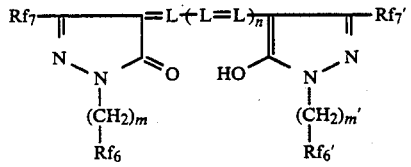

wherein $Rf_6$ and $Rf_6'$ represent each a hydrogen atom, an alkyl group, an aryl group, or a heterocylic group, $Rf_7$ and $Rf_7'$ represent each a hydroxy group, an alkoxy group, a substituted alkoxy group, a cyano group, a trifluoromethyl group, a —$COORf_8$ group, a —$CONHRf_8$ group, a —$NHCORf_8$ group, an amino group, a substituted amino group having an alkyl group with a carbon number of 1 to 4 as a substituent, or a cyclic amino group represented by the Formula

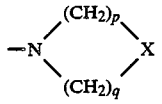

(wherein p and q represent each 1 or 2, and X represents an oxygen atom, a sulfur atom, or a —$CH_2$— group), $Rf_8$ represents a hydrogen atom, an alkyl group, or an aryl group, L represents a methine group, n represents 0, 1, or 2, and m and m' represent each 0 or 1.

General Formula (AI-III)

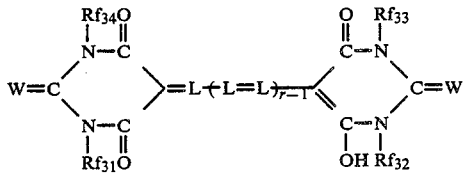

wherein r represents an integer of 1 to 3, W represents an oxygen atom and a sulfur atom, L represents a methine group, and $Rf_{31}$ through $Rf_{34}$ represent each a hydrogen atom, an alkyl group, an aryl group, an aralkyl group, or a heterocylic group such that at least one or more of $Rf_{31}$ through $Rf_{34}$ represent a substituent group other than the hydrogen atom.

General Formula (AI-IV)

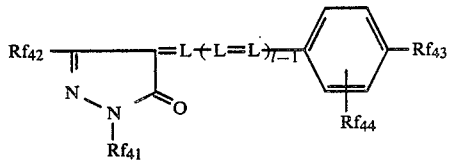

wherein l represents an integer of 1 or 2, L represents a methine group, $Rf_{41}$ represents an alkyl group, an aryl group, or a heterocyclic group, $Rf_{42}$ represents a hydroxy group, an alkyl group, an alkoxy group, a substituted alkoxy group, a cyano group, a trifluoromethyl group, a —$COORf_8$ group, a —$CONHRf_8$ group, a —$NHCORf_8$ group, an amino group, a substituted amino group having an alkyl group with a carbon number of 1 to 4 as a substituent, or a cyclic amino group represented by the Formula

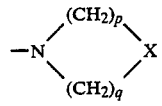

(here p and q represent each 1 or 2, and X represents an oxygen atom, a sulfur atom, or a —$CH_2$—group), $Rf_8$ represents a hydrogen atom, an alkyl group, or an aryl group, $Rf_{43}$ represents a —$ZO_1$ group or a

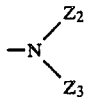

group, in which $Z_1$, $Z_2$, and $Z_3$ represent each a hydrogen atom or an alkyl group and $Z_2$ and $Z_3$ may be the same as or different from each other or to join in a ring, and $Rf_{44}$ represents a hydrogen atom, an alkyl group, a chlorine atom, or an alkoxy group.

General Formula (BS-I)

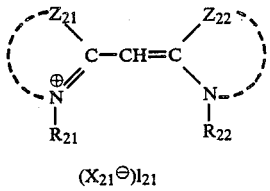

wherein $Z_{21}$ and $Z_{22}$ represent each a group of atoms necessary for forming the nucleus of imidazole, oxazole, thiazole, selenazole, pyridine, benzoxazole, benzothiazole, benzoselenazole, benzoimidazole, naphthoxazole, naphthothiazole, naphthoselenazole, naphthoimidazole, or quinoline, including the nuclues of a substitution product of any of these compound; $R_{21}$ and $R_{22}$ represent each an alkyl group or an alkenyl group or one of these groups containing a substituent; $X_{21}$ represents an anion and $l_{21}$ represents 0 or 1.

By the term "final processing solution"this invention refers to a treating solution employed at a final processing step, such as a stabilizing solution, rinsing solution and cleaning solution, and especially a stabilizing solution as being preferable.

This invention will hereunder be described in more detail with respect to the compounds represented by said General Formula (AI-I) through (AI-IV).

In General Formula (AI-I), Rf, $Rf_1$, $Rf_2$, $Rf_3$, $Rf_4$, and $Rf_5$ represent each a hydrogen atom, a halogen atom (e.g., a chlorine atom, a bromine atom, and a fluorine atom), a hydroxy group, an alkyl group (preferably one with a carbon number of 1 to 4, such as methyl, ethyl, and propyl), an alkoxy group (e.g., a methoxy group, an ethoxy group, and a propoxy group), a —$SO_3M$ group, or a —$NHCH_2SO_3M$ group; M represents a cation, such as an alkali metal atom (i.e., a sodium atom, a potassium atom, etc.), ammonium, and organic ammonium salt (i.e., pyridium, piperidinium, triethylammonium, triethanolamine, etc.); and t represents an integer of 1 to 3.

Hereunder are shown examples typifying compounds represented by General Formula (AI-I), which, however, are not to be construed to limit the scope of this invention.

[Exemplary Compounds]

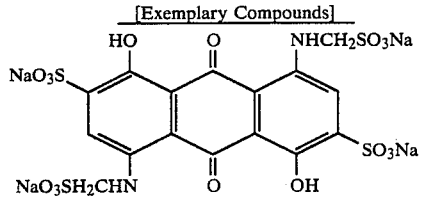

(I-1)

-continued

[Exemplary Compounds]

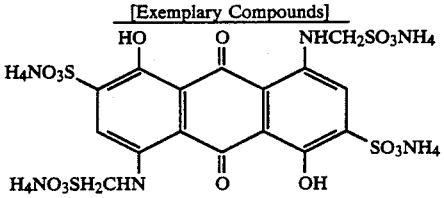

(I-2)

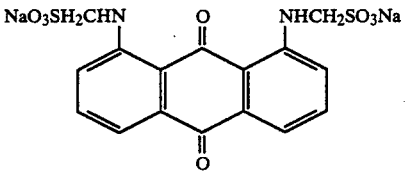

(I-3)

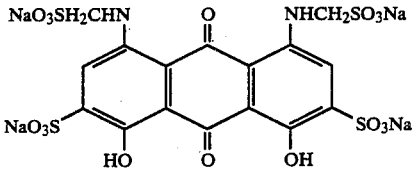

(I-4)

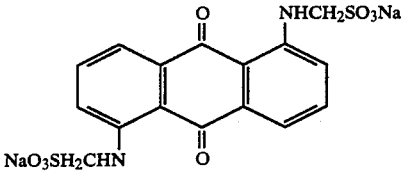

(I-5)

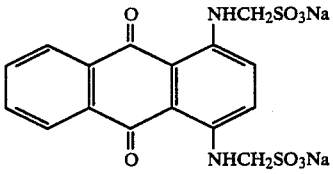

(I-6)

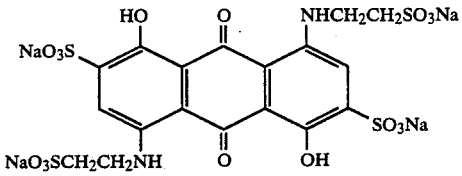

(I-7)

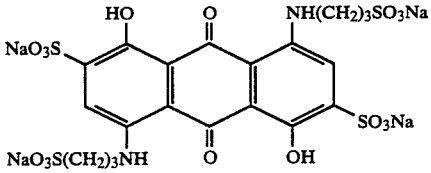

(I-8)

In General Formula (AI-II), $Rf_6$ and $Rf_6'$ represent each a hydrogen atom, or an alkyl group, an aryl group, or a heterocylic group, any of which groups may contain a substituent.

Examples of an aryl group which $Rf_6$ or $Rf_6'$ may represent are groups identified as 4-sulfophenyl, 4-(sulfomethyl)phenyl, 4-(δ-sulfobutyl)phenyl, 3-sulfophenyl, 2,5-disulfophenyl, 3,5-disulfophenyl, 6,8-disulfo-2-naphthyl, 4,8-disulfo-2-naphthyl, 3,5-dicarboxyphenyl, and 4-dicarboxyphenyl. An aryl group for $Rf_6$ or $Rf_6'$ may contain a sulfo group, a sulfoalkyl group, a carboxy group, an alkyl group with a carbon number of 1 to 5 (i.e., a methyl group, an ethyl group, etc.), a halogen atom (i.e., a chlorine atom, a bromine atom, etc.), an alkoxy group with a carbon number of 1 to 4 (i.e., a methoxy group, an ethoxy group, etc.), a phenoxy group, or the like. A sulfo group may be bonded to an aryl group with the interposition of a divalent organic group, examples being groups identified as 4-(4-sulfophenoxy)phenyl, 4-(2-sulfoethyl)phenyl, 3-(sulfomethylamino)phenyl, and 4-(2-sulfoethoxy)phenyl.

An alkyl group is useful for $Rf_6$ or $Rf_6'$ irrespective of whether it is of the straight chain or the branched chain or the cyclic type; preferable is one with a carbon number of 1 to 4, such as an ethyl group or a β-solfoethyl group.

Useful as a heterocyclic group for $Rf_6$ or $Rf_6'$ is, for example, a 2-(6-sulfo)benzothiazolyl group or a 2-(6-sulfo)benzoxazolyl group, which may contain a substituent, said substituent being a halogen atom (i.e., a fluorine atom, a chlorine atom, a bromine atom, etc.), an alkyl group (i.e., a methyl group, an ethyl group, etc.), an aryl group (e.g., a phenyl group), a carboxy group, a sulfo group, a hydroxy group, an alkoxy group (e.g., a phenoxy group), or an aryloxy group (e.g., a phenyl group).

$Rf_7$ and $Rf_7'$ represent each a hydroxy group, an alkoxy group with a carbon number of 1 to 4 (e.g., a methoxy group, an ethoxy group, an isopropoxy group, and a n-butyl group), substituted an alkoxy group, such as an alkoxy group with a carbon number of 1 to 4 which has, for example, a halogen atom or an alkoxy group with a carbon number of 1 or 2 as a substituent (e.g., a β-chloroethoxy group and a β-methoxyethoxy group), a cyano group, a trifluoromethyl group, —$COORf_8$*, —$CONHRf_8$*, —$NHCORf_8$* [*$Rf_8$ represents a hydrogen atom, an alkyl group (preferably an alkoxy group with a carbon number of 1 to 4)], or an aryl group (e.g., a phenyl group and a naphthyl group), or said alkyl group or an aryl group may have a sulfo group or a carboxy group as the substituent), an amino group, a substituted amino group having an alkyl group with a carbon number of 1 to 4 as the substituent (e.g., an ethylamino group, a dimethylamino group, a diethylamino group, and a di-n-butylamino group), or a cyclic amino group represented by the Formula

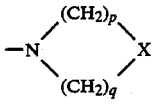

(here p and q represent each an integer of 1 or 2, and X represents an oxygen atom, a sulfur atom, or a —$CH_2$-group), examples of which are a morpholino group, a piperidino group or a piperazino group.

The methine group represented by L can be a substituted one having as a substituent an alkyl group with a carbon number of 1 to 4 (e.g., a methyl group, an ethyl group, an isopropyl group, and a tertiary butyl group) or an aryl group (e.g., a phenyl group and a tolyl group).

With respect to a sulfo group, a sulfoalkyl group, and a carboxy group in a compound (AI-II), at least one of said groups may form a salt with an alkali metal (e.g., sodium and potassium), an alkaline earth metal (e.g., calcium and magnesium), an ammonium, or an organic base (e.g., a diethylamine, triethylamine, morpholine group, a pyridine group, and a piperidine group).

n represents 0, 1, or 2. m and m' represent each 0 or 1.

Hereunder ar shown examples typifying compounds represented by General Formula (AI-II), which, however, are not to be construed to limit the scope of this invention.
[Exemplary Compounds]
(II-1)
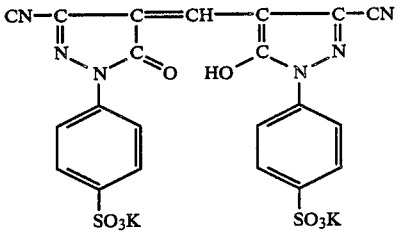
(II-2)
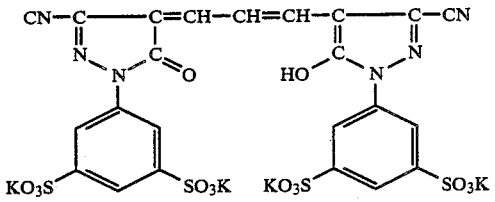
(II-3)
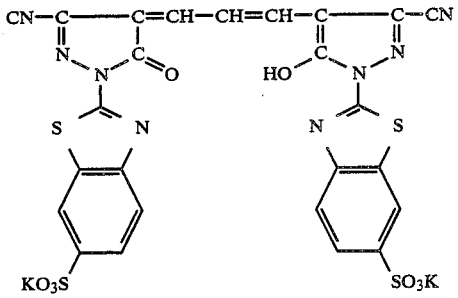
(II-4)
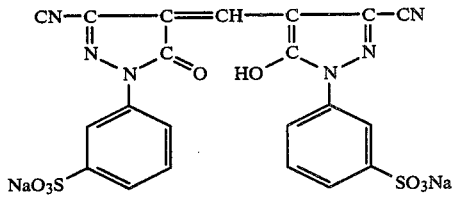
(II-5)
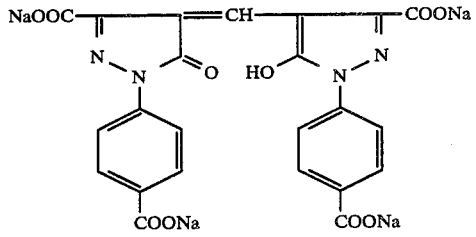
(II-6)
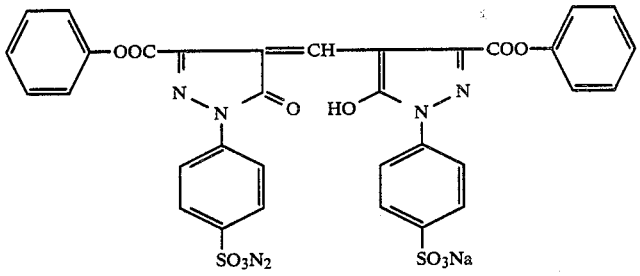

-continued
[Exemplary Compounds]
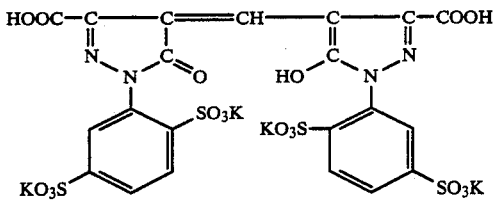
(II-7)
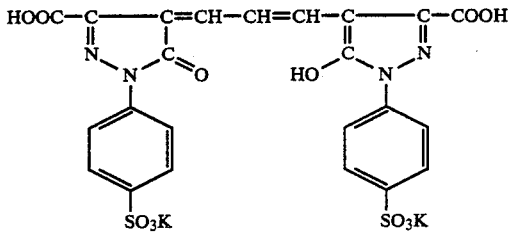
(II-8)
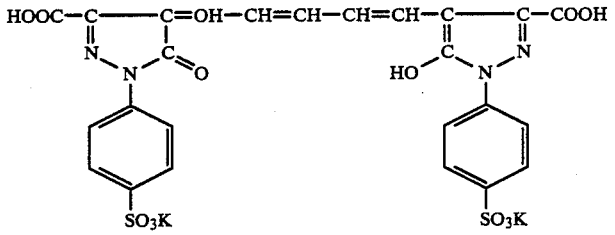
(II-9)
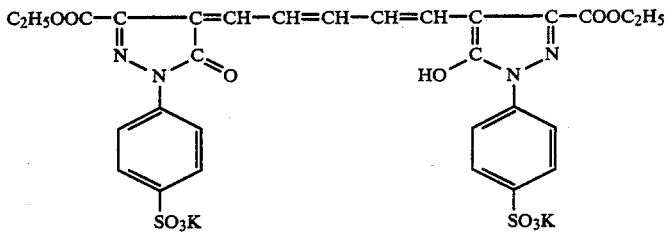
(II-10)
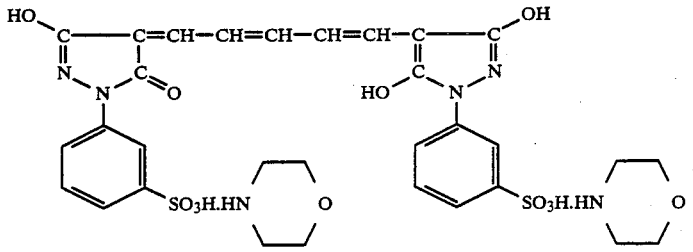
(II-11)
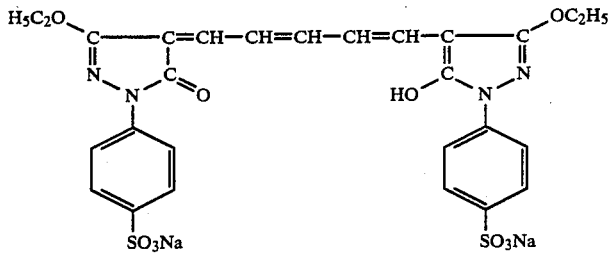
(II-12)

-continued
[Exemplary Compounds]
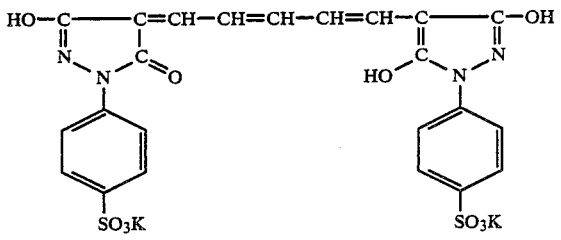
(II-13)
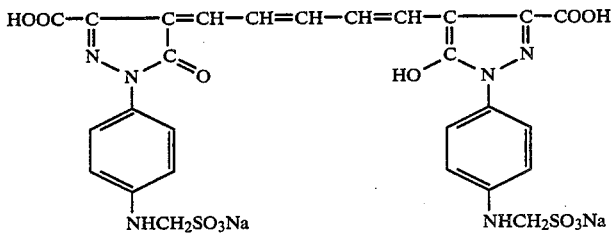
(II-14)
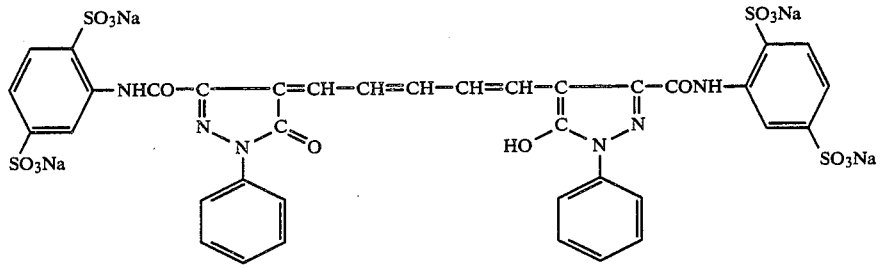
(II-15)
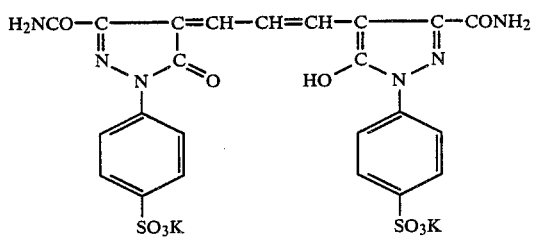
(II-16)
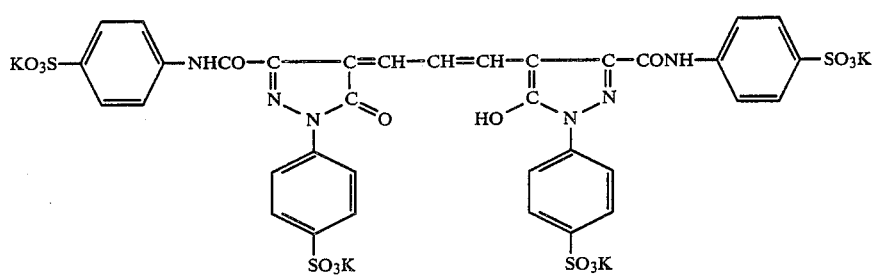
(II-17)
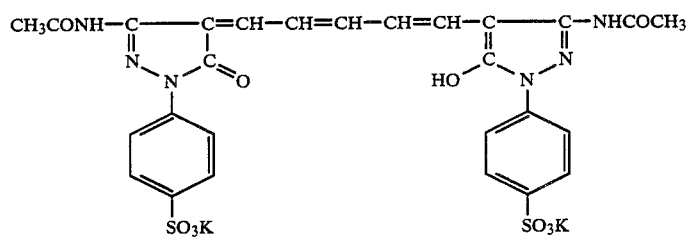
(II-18)

-continued
[Exemplary Compounds]
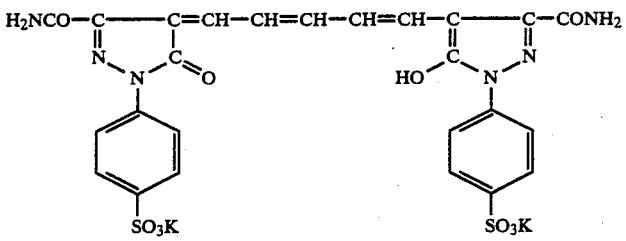
(II-19)
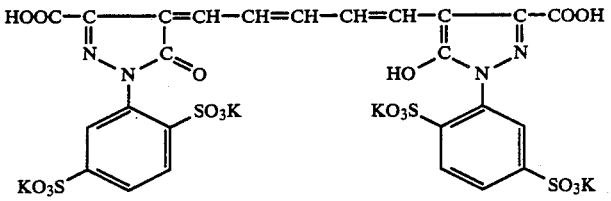
(II-20)
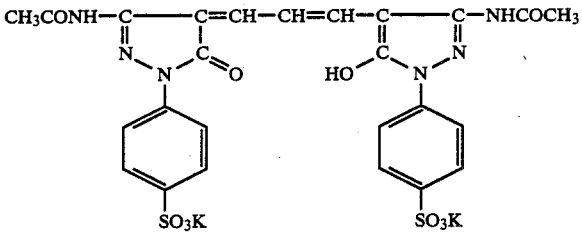
(II-21)
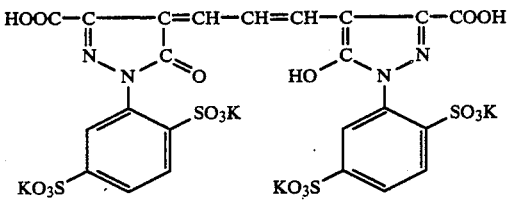
(II-22)
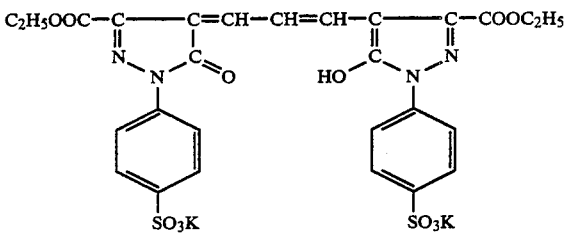
(II-23)
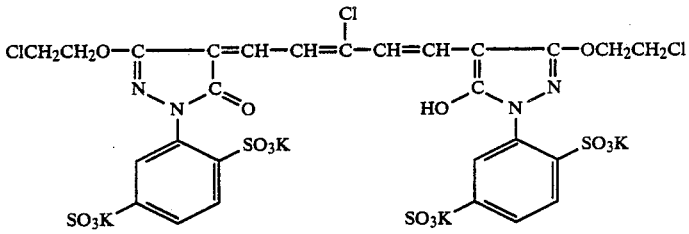
(II-24)
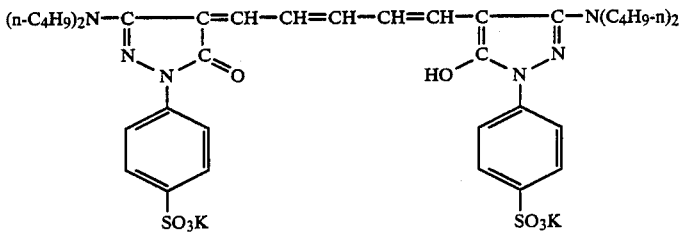
(II-25)

-continued

[Exemplary Compounds]

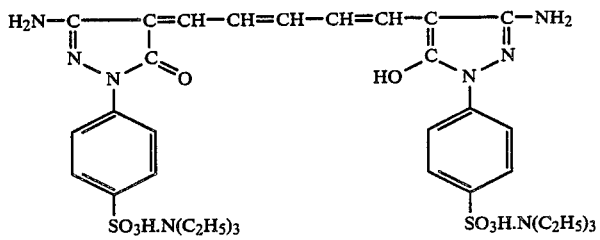

(II-26)

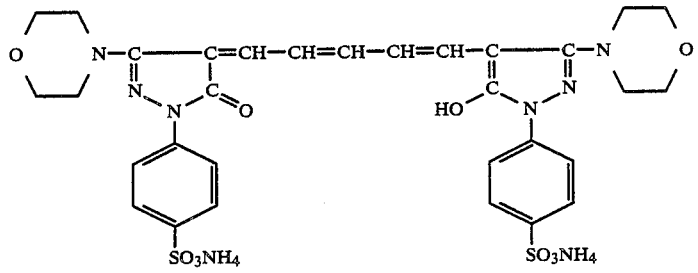

(II-27)

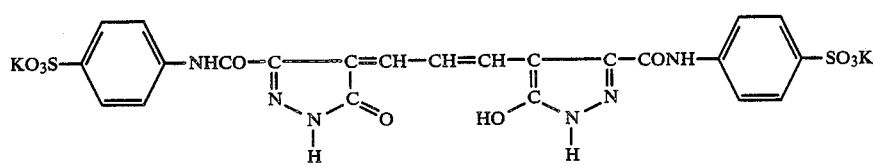

(II-28)

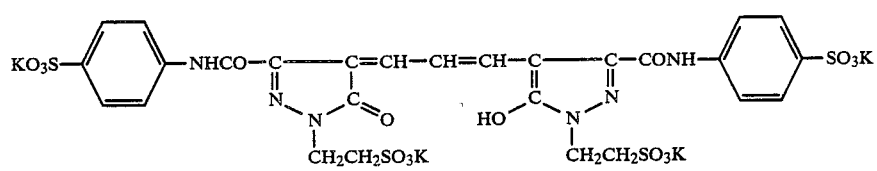

(II-29)

In General Formula (AI-III), r represents an integer of 1 to 3, W represents an oxygen atom and a sulfur atom, L represents a methine group, and $Rf_{31}$ through $Rf_{34}$ represent each a hydrogen atom, an alkyl group, an aryl group, an aralkyl group, or a heterocylic group such that at least one or more of $Rf_{31}$ through $Rf_{34}$ represent a substituent group other than a hydrogen atom.

A methine group represented by L can be any that is hereinabove described as useful for a methine group in General Formula (AI-II).

An alkyl group which $Rf_{31}$ through $Rf_{34}$ may represent can be any that is hereinbefore described as useful for an alkyl group for $Rf_6$ or $Rf_6'$ in General Formula (AI-II). An alkyl group for $Rf_{31}$ through $Rf_{34}$ can be one having a substituent group; useful for this alkyl group are, for example, the various substituent groups which can be introduced into the group for $Rf_6$ or $Rf_6'$ as mentioned in the description of General Formula (AI-II), but desirable is the presence of a sulfo group, a carboxy group, a hydroxy group, an alkoxy group, an alkoxycarbonyl group, a cyano group, and a sulfonyl group.

An aryl group represented by $Rf_{31}$ through $Rf_{34}$ is preferably, a phenyl group. Useful as a substituent group to be introduced into this phenyl group are the various substituents which are given as useful for $Rf_6$ and $Rf_6'$ in the description of General Formula (AI-II), but it is desirable for the aromatic ring to have thereon at least one of three groups — a sulfo group, a carboxy group, and a sulfamoyl group.

As an aralkyl group represented by $Rf_{31}$through $Rf_{34}$, a benzyl group or a phenethyl group is desirable. Substituent groups which can be introduced into such an aralkyl group are the same as those hereinabove given as useful for an aryl group for $Rf_{31}$ through $Rf_{34}$.

Examples of a heterocyclic group represented by $Rf_{31}$ through $Rf_{34}$ are a pyridyl group and a pyrimidyl group. Substituent groups which can be introduced into the ring structure are the same as those hereinabove given as useful for an aryl group for $Rf_{31}$ through $Rf_{34}$.

As groups represented by $Rf_{31}$ through $Rf_{34}$ an alkyl group or an aryl group is desirable. It is furthermore desirable for at least one of three groups — a carboxy group, a sulfo group, and a sulfamoyl group — to be present in the molecule of barbituric acid or in that of thiobarbituric acid which are represented by General Formula (AI-III); a symmetrical form is desirable.

Hereunder are shown examples of typifying compounds represented by General Formula (AI-III), which, however, are not to be construed to limit the scope of this invention.

[Exemplary Compounds]
(III-1)
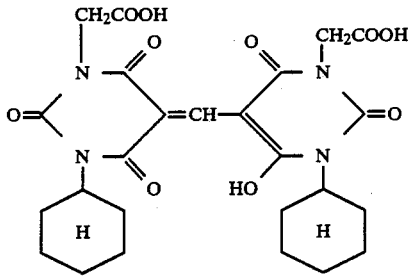
(III-2)
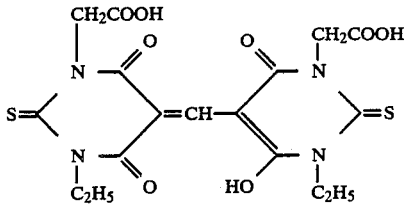
(III-3)
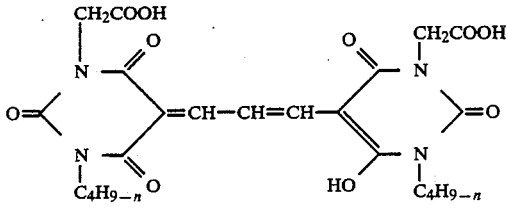
(III-4)
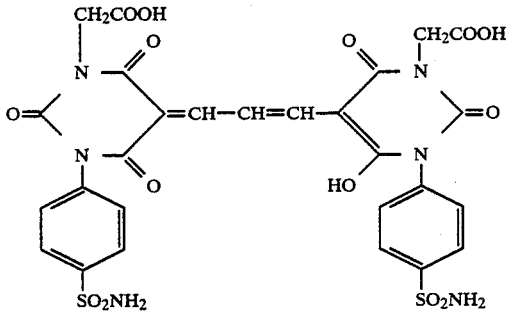
(III-5)
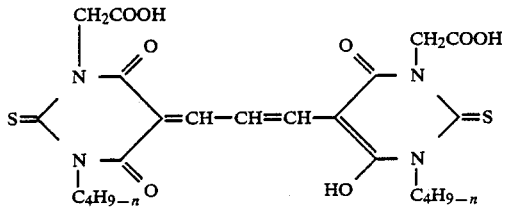
(III-6)
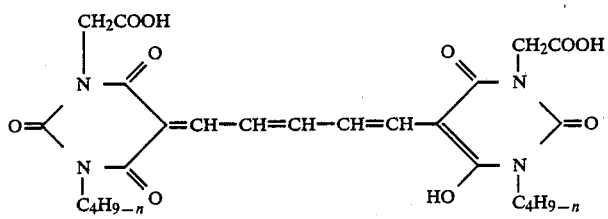

-continued

[Exemplary Compounds]

(III-7)

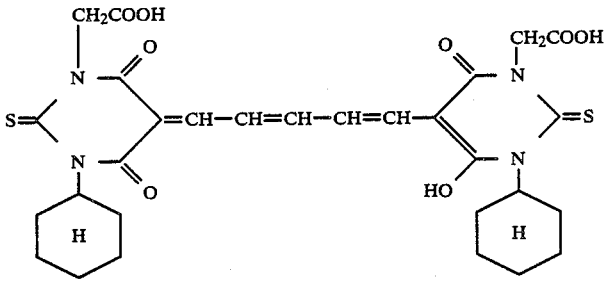

In General Formula (AI-IV), the symbols have the following means.

l represents an integer of 1 or 2.

L represents a methine group.

$Rf_{41}$ has virtually the same significations as $Rf_6$ or $Rf_6'$ in General Formula (AI-II): it is desirable for it to have an alkyl group or an aryl group and for an aryl group to contain at least one sulfo group.

$Rf_{42}$ can have any of the substituent groups which are hereinbefore given with respect to $Rf_7$ and $Rf_7'$ in General Formula (AI-II) and is selected from the group consisting of an alkyl group, a carboxy group, an alkoxycarbonyl group, a carbamoyl group, an ureido group, an acylamino group, an imido group, and a cyano group.

$Rf_{43}$ represents a $—OZ_1$ group or a

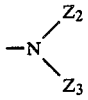

group, in which $Z_1$, $Z_2$ and $Z_3$ represent each a hydrogen atom or an alkyl group and $Z_2$ and $Z_3$ may be the same as or different from each other or to join to form a ring.

Examples of an alkyl group which $Z_1$, $Z_2$, and $Z_3$ may represent are a methyl group, an ethyl group, a butyl group, a hydroxyalkyl group (e.g., a hydroxyethyl group), an alkoxyalkyl group (e.g., a β-ethoxyethyl group), a carboxyalkyl group (e.g., a β-carboxyethyl group), an alkoxycarbonylalkyl group (e.g., a β-ethoxycarbonylethyl group), a cyanoalkyl group (e.g., a β-diaminoethyl group), and a sulfoalkyl group (e.g., a β-sulfoethy group and a γ-sulfopropyl group).

$Z_2$ and $Z_3$ can be bonded to each other to form a 5-membered or 6-membered ring, such as a morpholino group, a piperidino group, and a pyrrolidino group.

$Rf_{44}$ represents a hydrogen atom, an alkyl group, a chlorine atom, or an alkoxy group; a methoxy group and an ethoxy group can be given as examples of an alkoxy group.

Hereunder are shown examples typifying compounds represented by General Formula (AI-IV), which, however, are not to be construed to limit the scope of this invention.

[Exemplary Compounds]

(IV-1)

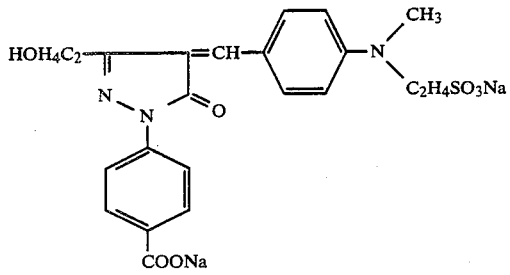

(IV-2)

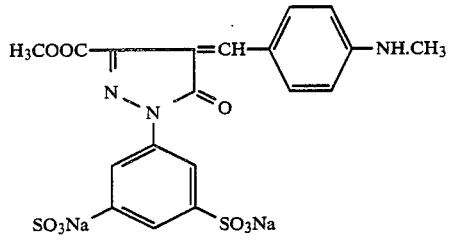

-continued
[Exemplary Compounds]
(IV-3)
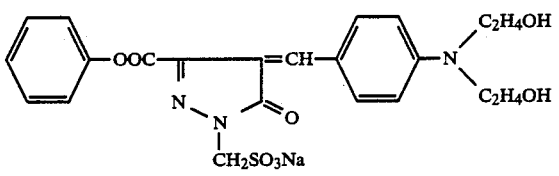
(IV-4)
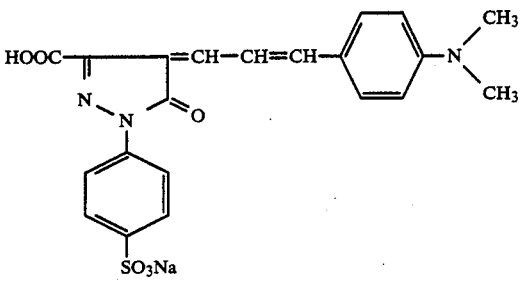
(IV-5)
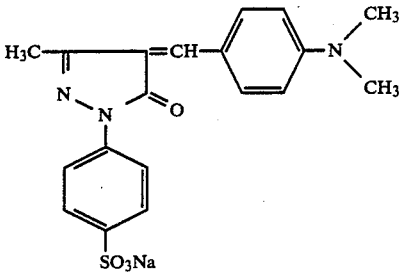
(IV-6)
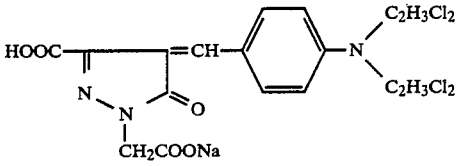
(IV-7)
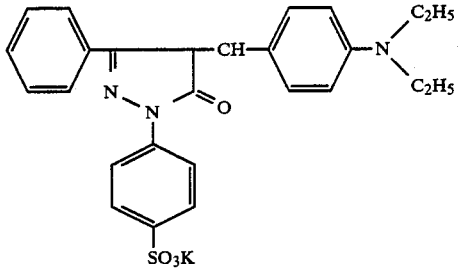
(IV-8)
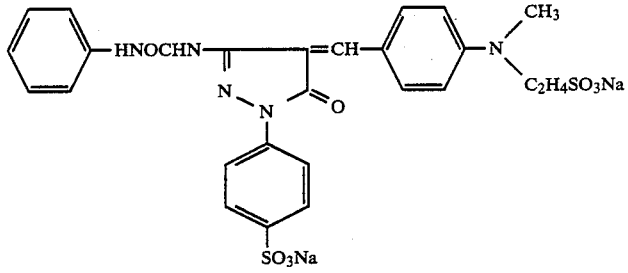
The compounds represented by General Formulas (AI-I), (AI-II), (AI-III), and (AI-IV) hereinbefore described can be synthesized by the methods of synthesis described in U.S. Pat. Nos. 3,575,704, 3,247,127, 3,540,887, and 3,653,905 and Japanese Patent O.P.I. Publication Nos. 85130/1973, 99620/1974, 111640/1984, 111641/1984, and 170838/1984.

Referring now to General Formula (BS-I), the compounds represented thereby can be described in more detail as follows.

As a heterocyclic nucleus represented by $Z_{21}$ and $Z_{22}$ respectively, desirable is the nucleus of imidazole, thiazole, selenazole, benzothiazole, benzoselenazole, naphthoxazole, or naphthothiazole, of which benzothiazole nucleus and benzoselenazole nucleus are more desirable than the others and benzothiazole nucleus is the most desirable.

A heterocyclic nucleus represented by $Z_{21}$ and $Z_{22}$ respectively can be one having a substituent group; desirable as a substituent in this instance is, for example, a halogen atom, a hydroxy group, an aryl group, an alkyl group, or an alkoxy group. As a halogen atom for the substitution a chlorine atom is preferable; as an aryl group likewise a phenyl group is preferable; as an alkyl group likewise one of the straight chain or the branched chain with a carbon atom number of 1 to 4 is preferable, examples being a methyl group, an ethyl group, a propyl group, an isopropyl group, and a butyl group and a methyl group being especially preferable; as an alkoxy group likewise one with a carbon atom number of 1 to 4 is preferable, examples being a methoxy group, an ethoxy group, and a propoxy group and a methoxy group being especially preferable.

As an alkyl group which $R_{21}$ or $R_{22}$ may represent the presence of one of the straight chain or the branched chain with a carbon atom number of 1 to 6 is desirable; a methyl group, an ethyl group, a propyl group, and an isopropyl group are examples. Such alkyl groups can be ones having substituent groups, desirable substituents in such cases being, for example, groups identified as sulfo, carboxyl, hydroxyl, alkoxycarbonyl, and alkylsulfonylamino.

As an alkyl group which $R_{21}$ or $R_{22}$ may represent it is desirable to have one which has a sulfo group or a carboxyl group as a substituent. Such a sulfo group, a carboxyl group, or the like can be one forming a salt with an organic cation such as a pyridinium ion or triethylammonium ion or with an inorganic cation such an ammonium ion, a sodium ion or a potassium ion.

In the case where the heterocyclic nucleus represented by $Z_{21}$ and/or $Z_{22}$ respectively is a condensed.-noncondensed imidazole nucleus, a nitrogen atom which is not bonded to $R_{21}$ or $R_{22}$ may have a substituent group, for which it is desirable to have an alkyl group, especially one of the straight chain or branched chain with a carbon atom number of 1 to 6 such as a methyl group, an ethyl group, a propyl group, or an isopropyl group. This alkyl group can be one having a substituent group, examples of a desirable substituent being a hydroxyl group, an alkoxycarbonyl group, an alkylsulfonylamino group, and an aryl group is desirable.

$X_{21}\theta$ represents an anion, for which the ion of, for example, a chloride, a bromide, an iodide, or a p-toluensulfonate is useful but a halide ion is preferable. In the case where an inner salt is formed, the anion is not required to be included and $l_{21}$ represents 0.

Hereunder are shown examples typifying sensitizing dyes represented by General Formula (BS-I), which, however, are not to be construed to limit the scope of this invention.

(BS-I-1)

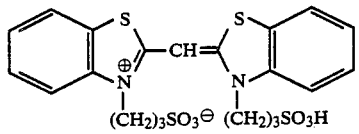

(BS-I-2)

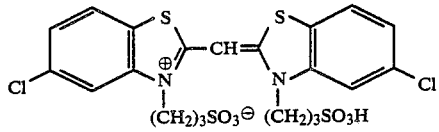

(BS-I-3)

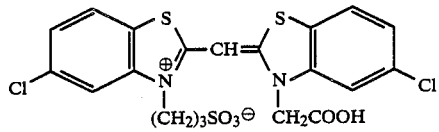

(BS-I-4)

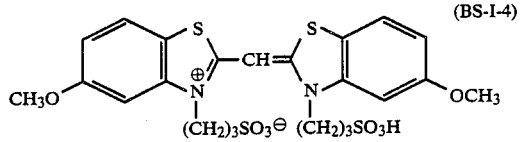

(BS-I-5)

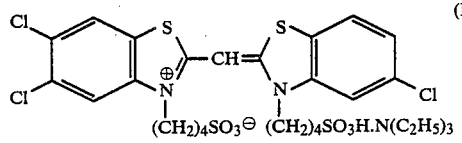

(BS-I-6)

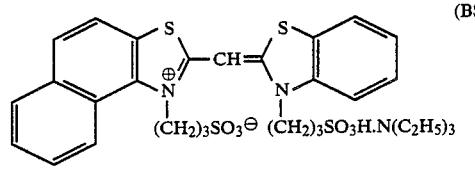

(BS-I-7)

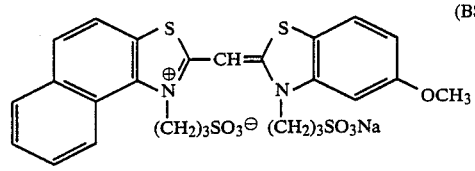

(BS-I-8)

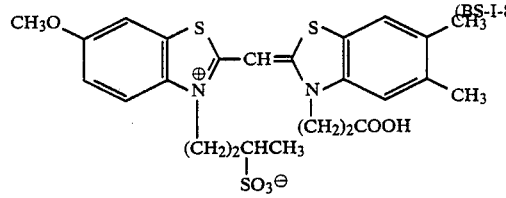

(BS-I-9)

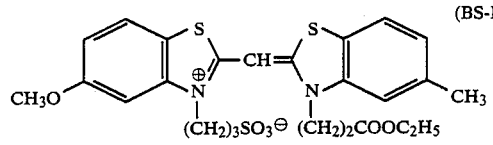

(BS-I-10)

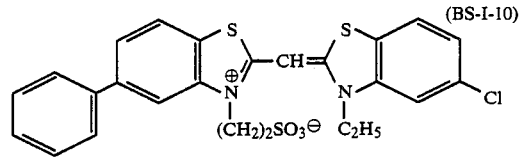

-continued (BS-I-11)

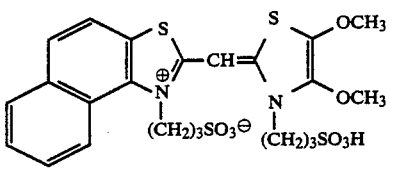

(BS-I-12)

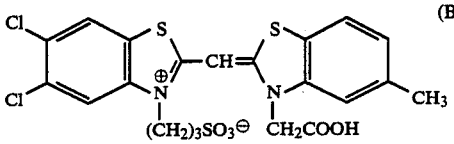

(BS-I-13)

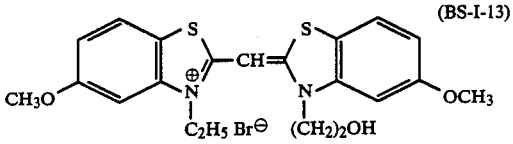

(BS-I-14)

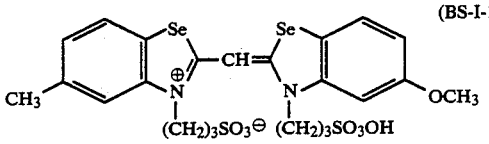

(BS-I-15)

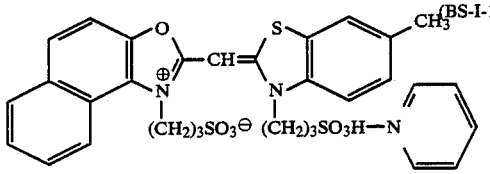

(BS-I-16)

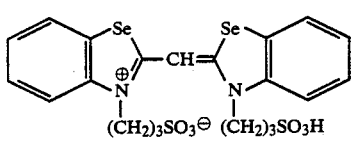

(BS-I-17)

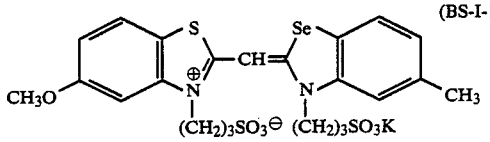

(BS-I-18)

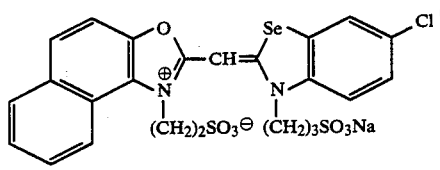

(BS-I-19)

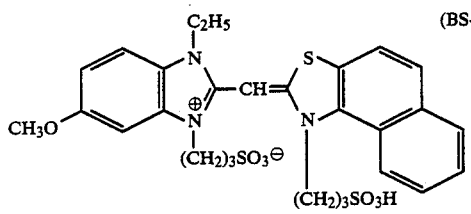

-continued (BS-I-20)

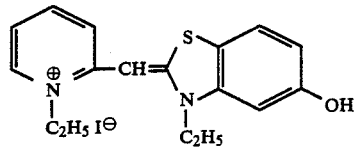

The above-mentioned (BS-I) examples are known compounds, which can be synthesized easily, for example, by the methods described in "The Cyanine Dyes and Related Compounds"by Harmer, Interscience Publishers, New York (1964).

Any of compounds represented by General Formula (AI-I), (AI-II), (AI-III), or (AI-IV) can be introduced into the stabilizing solution in photographic processing by being added directly to the stabilizing bath or by being added to a preceding bath and carried by the photosensitive material. When incorporated into the photosensitive material, the compound can be added to a silver halide emulsion or other hydrophilic colloid; an organic or an inorganic alkali salt of a compound of this invention named above is dissolved in water to form an aqueous dye solution of suitable concentration, which then is added to a coating liquid for coating photographic material by a known method.

A compound represented by General Formula (AI-I), (AI-II), (AI-III), or (AI-IV), when incorporated into a photosensitive material, is to be employed in a quality in a range of 1 to 800 mg, preferably from 2 to 200 mg, per $m^2$ of the photosensitive material, and when directly added to a stabilizing solution, it is desirable to use the compound in a quantity of 0.005 to 200 mg per liter, especially in a quantity of 0.01 to 50 mg per liter, of the solution.

A compound represented by General Formula (BS-I) is used preferably in an amount of $5\times10^{-5}$ to $2\times10^{-3}$ mol per mol of silver halide, and more preferably, in an amount of $1\times10^{-4}$ to $7\times10^{-7}$ mol per mol of silver halide.

Among compounds represented by (AI-I) to (AI-IV), the use of compounds represented by General Formula (AI-II) is most desirable. Two or more different types of compounds of these can also be used in combination.

In the case where a compound of this invention (AI-I), (AI-II), (AI-III), or (AI-IV) is incorporated into a photosensitive material in a method to have it dissolve out into a stabilizing bath, the concentration in which said compound dissolves to be present in the stabilizing bath is dependent not only on the quantity of the replenisher used for a unit area of the photosensitive material but also on the time and temperature of the treatment at preceding processing steps, that is to say, in a color developing step and a bleach-fixing step.

In a continuous processing system, it is preferable for the replenisher in an integrated composition for each of the color developing bath and the bleach-fixing bath, which both precede the stabilizing bath, to be fed at a quantity not more than 1l per $m^2$ of a photosensitive material; more preferable is for the quantity to be not more than 600 ml. In replenishing the stabilizing bath, it is preferable to feed the replenisher at a quantity of not more than 2l per $m^2$ of a photosensitive material, more preferable is to feed it by not more than 1l per $m^2$ and most preferable is to feed it by not more than 500 ml per $m^2$.

In the practice of this invention, it is desirable for the stabilizing bath to contain a sulfite, for which whereas whatever sulfite releases a sulfite ion is suitable irrespective of whether it is an organic product or an inorganic product, it is preferable to have an inorganic salt; exemplary compounds for this purpose are sodium sulfite, potassium sulfite, ammonium sulfite, ammonium bisulfite, potassium bisulfite, sodium bisulfite, sodium metabisulfite, potassium metabisulfite, ammonium metabisulfite, and hydrosulfite.

The sulfite above-mentioned is, preferably, added to a stabilizing bath in a quantity of at least $1\times10^{-3}$ mol per liter, and, more preferably, in a quantity in the range of from $5\times10^{-3}$ mol to $10^{-1}$ mol per liter. The sulfite can be added to the bath directly, but it is preferable for the sulfite to be added first to the stabilizing bath replenisher.

The present invention is applicable to a stabilizing system using two to four vessels, but is preferable for the stabilization to use only one vessel.

In the practice of this invention, it is especially preferable for ammonium compounds to be used in the stabilizing bath.

Useful for this purpose are ammonium salts of various inorganic compounds, specifically such as ammonium hydroxide, ammonium bromide, ammonium carbonate, ammonium chloride, ammonium hypophosphite, ammonium phosphate, ammonium phosphite, ammonium fluoride, ammonium bifluoride, ammonium fluoroborate, ammonium arsenate, ammonium bicarbonate, ammonium bifluoride, ammonium hydrogen sulfide, ammonium sulfate, ammonium iodide, ammonium nitrate, ammonium pentaborate, ammonium acetate, ammonium adipate, ammonium lauric tricarboxylate, ammonium benzoate, ammonium carbamate, ammonium citrate, ammonium diethyldithiocarbamate, ammonium formate, ammonium hydrogen malate, ammonium binoxalate, ammonium phthalate, ammonium bitartrate, ammonium thiosulfate, ammonium sulfite, ammonium ethylenediamine tetraacetate, ferric ammonium ethylenediamine tetraacetate, ammonium lactate, ammonium malate, ammonium malate, ammonium oxalate, ammonium phthalate, ammonium picrate, ammonium pyrrolidinedithiocarbamate, ammonium salicylate, ammonium succinate, ammonium sulfanilate, ammonium tartrate, ammonium thioglycolate, and ammonium 2,4,6-trinitrophenolate. Any of such compounds can be used independently of other ammonium salts or in combination with one or more different ammonium salts as well.

Such ammonium compounds are added to a stabilizing bath in a quantity in the range of 0.001 mol to 1.0 mol per liter, and, preferably in the range of 0.002 mol to 0.2 mol.

It is desirable for a stabilizing bath prepared according to this invention to have the pH in the range of 3.0 to 9.5, or in the range of 3.5 to 9.0 which range is more contributive to achieving the intended effect of this invention.

It is favorable to the practice of this invention, furthermore, for a stabilizing bath in this invention to contain a chelating agent for an iron ion each with a chelate stability constant of 8 or more.

The term "chelate stability constant"herein means the same known constant as that referred to, for example, in "Stability Constants of Metal-ion Complexes"-(Sillen, L.G. and Martell, A.E., The Chemical Society, London (1964) and "Organic Sequestering Agents"(-Chaberek, S. and Martell, A.E., Wiley (1959).

As a chelating agent chelating with an iron ion and forming a chelating compound with a chelate stability constant of 8 or more which is, preferably, used in the stabilizing bath, use can be made of, for example, organic carboxylic acids, organic carboxylic acids, organic phosphoric acids, inorganic phosphoric acids, and polyhydroxy compounds. The iron ion mentioned above means the ferric ion ($Fe^{3+}$).

Hereunder are exemplified examples of a compound useful as a chelating agent for the ferric ion with a chelate stability constant of 8 or more, to which, however, the use of chelating agents for the ferric ion is not to be confined: the examples are ethylenediaminediorthohydroxyphenylacetic acid, diaminopropane tetraacetic acid, nitrilotriacetic acid, hydroxyethylenediamine triacetic acid, dihydroxyethylglycine, ethylenediamine diacetic acid, ethylenediaminedipropionic acid, iminodiacetic acid, diethylenetriaminepentaacetic acid, hydroxyethyliminodiacetic acid, diaminopropanol tetraacetic acid, trans-cyclohexanediaminetetraacetic acid, glycoletherdiaminetetraacetic acid, ethylenediamine tetrakismethylene phosphonic acid, nitrilotrimethylene phosphonic acid, 1-hydroxyethylidene-1,1-diphosphonic acid, 1,1-diphosphonoethane-2-carboxylic acid, 2-phosphonobutane-l,2,4-tricarboxylic acid, 1-hydroxy-1-phosphonopropane-1,2,3-tricarboxylic acid, catechol-3,5-diphosphonic acid, sodium pyrophosphate, sodium tetrapolyphosphate, and sodium hexametaphosphate, of which preferable is the use of diethylenetriaminepentaacetic acid, nitrilotriacetic acid, nitrilotrimethylene phosphonic acid, 1-hydroxyethylidene-1,1-diphosphonic acid, or the like and the most favorable is the use of 1-hydroxyethylidene-1,1-diphosphonic acid.

The above-mentioned chelating agents are effective when added to a stabilizing bath in a quantity in the range of 0.01 to 50 g per liter, for more desirable effects in the range of 0.05 to 20 g.

Besides the above-mentioned compounds, use can be made of compounds generally known to be useful in stabilizing baths, such as polyvinyl pyrrolidone (PVP, K-15, K-30, and K-90), salts of organic acids (e.g., salts of citric acid, acetic acid, succinic acid, oxalic acid, and benzoic acid), pH adjusters (e.g., phosphates, borates, hydrochloric acid, and sulfuric acid), mildewproofing agents (e.g., phenol derivatives, catechol derivatives, imidazole derivatives, triazole derivatives, thiabendazole derivatives, organic halogen compounds, and mildewproofing agents known to be in use in slime control in the pulp and paper industries), fluorescent whitening agents, surface-active agents, preservative agents, and metal salts, i.e., salts of Bi, Mg, Zn, Ni, Al, Sn, Ti, Zr, and the like. In adding to a stabilizing bath prepared according to this invention, such compounds can be selected and combined with one another in any way, insofar as their use is necessary for the stability of the pH of the stabilizing bath and the use involves no adverse consequences relating to the stability of color photographic images when preserved and the occurrences of precipitation.

The stabilizing treatment in this invention can be carried out at temperatures in the range of 15° to 60° C, or preferably in the range of 20° to 45° C. The time required for the treatment, which is required to be shortened to not more than 30 seconds in the object of this invention, is from 3 to 25 seconds; the preferable range of time, however, is from 4 to 20 seconds, and the optimum range of time is from 6 to 15 seconds. This invention renders it unnecessary for washing with water to follow the stabilizing treatment, but rinsing or cleaning or the surfaces with a small amount of water for a very short time or, the like may be included in the processing if necessary.

Soluble iron salts applicable to the practice of this invention include both inorganic iron salts and iron salts of organic acids: examples of inorganic iron salts are ferric chloride, ferrous chloride, ferric phosphate, ferric bromide, ferric nitrate, and ferrous nitrate, and examples of iron salts of organic acids are ferric ethylenediaminetetra acetate, ferric 1-hydroxyethylidene-1,1-diphosphonate, ferrous 1-hydroxyethylidene-1,1-diphosphonate, ferrous ethylenediaminetetra acetate, ferric diethylenetriamine pentaacetate, ferrous diethylenetriamine pentaacetate, ferric citrate, ferrous citrate, ferric ethylenediamine tetramethylene phosphonate, ferrous ethylenediamine tetramethylene phosphonate, ferric nitrilotrimethylene phosphonate, ferric nitrilotriacetate, and ferrous nitrilotriacetate. Such iron salts of organic acids can be of the free acid type as well as sodium salts, potassium salts, ammonium salts, lithium salts, and alkyl ammonium salts (e.g., tr iethanol ammonium salts, trimethyl ammonium salts, and tetramethyl ammonium salts).

In the practice of this invention, it is preferable to use iron salts of organic acids as soluble iron salts.

Such soluble iron salts in the above description are used in a stabilizing bath in a concentration of at least $5\times10^{-3}$ mol per liter; the preferable concentration is in the range of $8\times10^{-3}$ to $150\times10^{-3}$ mol per liter and the optium concentration is in the range of $12\times10^{-3}$ to $100\times10^{-3}$ mol per liter.

In adding to a stabilizing bath, the soluble iron salts in this invention can be added to the stabilizing bath replenisher so as to have them carried thereby to the stabilizing bath (tank liquid), or can be incorporated into the photosensitive materials so as to make the iron salts dissolve out into the stabilizing bath (tank liquid), or can be brought from the preceding bath with the processed photosensitive materials as the carrier and released therefrom into the stabilizing bath (tank liquid).

It is highly contributive to efficient practice of this invention for a photosensitive material to contain a magenta coupler represented by the undermentioned General Formula (M-I):

General Formula (M-I)

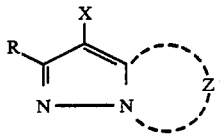

wherein Z represents a group of a nonmetalic atom necessary for forming a nitrogen-containing heterocycle, which may have a substituent group; X represents a hydrogen atom or a group capable of splitting off by reaction with an oxidized product of a color developing agent; R represents a hydrogen atom or a substituent group.

A substituent group which R may have is not confined to specific groups: typical examples are groups identified as alkyl, aryl, anilino, acylamino, sulfonamido, alkylthio, arylthio, alkenyl, and cycloalkyl; other exemplary substituents are halogen atoms, groups identified as cycloalkenyl, alkynyl, heterocycle, sulfonyl, sulfinyl, phosphonyl, acyl, carbamoyl, sulfamoyl, cyano, alkoxy, aryloxy, heterocyclic-oxy, siloxy, acyloxy, carbamoyloxy, amino, alkyamino, imido, ureido, sulfamoylamino, alkoxycarbonylamino, aryloxycarbonylamino, alkoxycarbonyl, aryloxycarbonyl, and heterocyclic-thio, spiro-compound residue, and bridged hydrocarbon compound residue.

An an alkyl group which R may represent the presence of one with a carbon number of 1 to 32 is desirable irrespective of whether it is of the straight chain or the branch chain.

As an aryl group which R may represent the presence of a phenyl group is desirable.

Examples of an acylamino group which R may represent are an alkylcarbonylamino group and an arylcarbonylamino group.

Examples of an sulfonamido group which R may represent are an alkylsulfonylamino group and an arylsulfonylamino group.

With respect to an alkylthio group and an arylthio group respectively which R may represent, it is desirable for their alkyl component and aryl component respectively to be what conforms to the above-mentioned descriptions of an alkyl group and an aryl group for R.

An an alkenyl group which R may represent the presence of one with a carbon number of 2 to 32 is desirable irrespective of whether it is of the straight chain or the branched chain. As a cycloalkyl group for R the presence of one with a carbon number of 3 to 12 is desirable; preferable as a cycloalkyl for R is one with a carbon number of 5 to 7, however.

As a cycloalkenyl group which R may represent the presence of one with a carbon number of 3 to 12 is desirable; preferable, however, is one with a carbon number of 5 to 7.

As a sulfonyl group which R may represent an alkylsulfonyl group and an arylsulfonyl group can be given as examples, and;

likewise, as a sulfinyl group, an alkylsulfinyl group and an arylsulfinyl group;

as a phosphonyl group the groups identified as an alkylphosphonyl group, an alkoxyphosphonyl group, an aryloxyphosphonyl group, and an arylphosphonyl group;

as an acyl group an alkylcarbonyl group and an arylcarbonyl group;

as a carbamoyl group an alkylcarbamoyl group and an arylcarbamoyl group;

as a sulfamoyl group an alkylsulfamoyl group and an arylsulfamoyl group;

as an acyloxy group an alkylcarbonyloxy group and an arylcarbonyloxy group;

as a carbamoyloxy group an alkylcarbamoyloxy group and an arylcarbamoyloxy group;

as an ureido group an alkylureido group and an arylureido group;

as a sulfamoylamino group an alkylsulfamoylamino group and an arylsulfamoylamino group;

as a heterocyclic group one of a 5- to 7-membered ring is desirable, such as a 2-furyl group, a 2-thienyl group, a 2-pyrimidinyl group, and a 2-benzothiazolyl group;

as a heterocyclic-oxy group one of a 5- to 7-membered heterocyclic ring is desirable, such as a 3,4,5,6-tetrahydropyranyl-2-oxy group and a 1-phenyltetrazol-5-oxy group;

as a heterocyclic-thio group one of a 5- to 7-membered ring is preferable, such as a 2-pyridylthio group, a 2-benzothiazolylthio group, and a 2,4-dephenoxy-l,3,5-triazol-6-thio group;

as a siloxy group a trimethylsiloxy group, a triethylsiloxy group, and a dimethylbutylsiloxy group;

as an imido group a succinimido group, a 3-heptadecylsuccinimido group, a phthalimido group, and a glutarimido group;

as a spiro-compound residue a spiro[3,3]heptan-1-yl group, and;

as a bridged hydrocarbon compound residue a bicyclo[2,2,l]heptan-1-yl, a tricyclo[3,3,1,$1^{3,7}$]decan-1-yl, and a 7,7-dimethyl-bicyclo[2,2,1]heptan-l-yl group can be given as examples.

As a group represented by X, i.e., one which can be split off by reaction with the oxidized product of a color developing agent are exemplified a halogen atom (i.e., a chlorine atom, a bromine atom, a fluorine atom, etc.) and groups identified as alkoxy, aryloxy, heterocyclicoxy, acyloxy, sulfonyloxy, alkoxycarbonyloxy, aryloxycarbonyl, alkyloxalyloxy, aroxyoxalyloxy, alkylthio, arylthio, heterocyclic-thio, alkyloxyxarbonylthio, acylamino, sulfonamido, nitrogen-containing heterocycle bonded by the N atom, alkyloxycarbonyldiamino, aryloxycarbonylamino, carboxyl, and

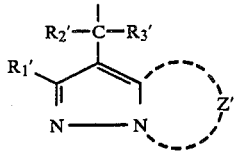

(wherein $R_1'$ has the same meaning as R mentioned above, Z' has the same meaning as Z mentioned above, and $R_2'$ and $R_3'$ represent each a hydrogen atom, an aryl group, an alkyl group, or a heterocyclic group). Among the above mentioned compounds is preferable a halogen atom and more preferable chlorine atom.

Examples of nitrogen-containing heterocycles which Z and Z' respectively form are a pyrazole ring, an imidazole ring, a triazole ring, and a tetrazole ring; such heterocycles can be ones having substituent groups, formed by introduction of substituents hereinabove described as useful for R.

The magenta couplers represented by General Formula (M-I) can, for example, be specifically divided into variants represented by General Formulas (M-II) through (M-VII) as follows:

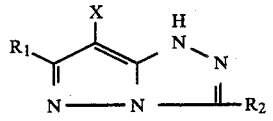

General Formula (M-II)

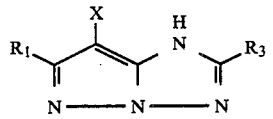

General Formula (M-III)

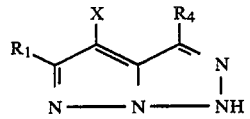

General Formula (M-IV)

-continued

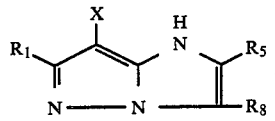

General Formula (M-V)

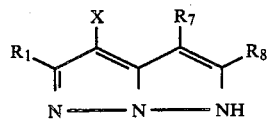

General Formula (M-VI)

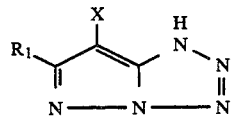

General Formula (M-VII)

$R_1$ through $R_8$ and X in General Formulas (M-II) through (M-VII) have the same meanings as R hereinbefore explained.

Preferable among the magenta couplers represented by General Formula (M-I) is one represented by the following General Formula (M-VIII):

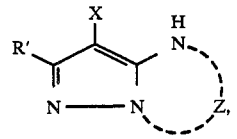

General Formula (M-VIII)

wherein $R_1$, X, and $Z_1$ have the same meanings as R, X, and Z respectively in General Formula (M-I).

Among the magenta couplers represented by General Formulas (M-II) through (M-VII) is preferable one represented by General Formula (M-II).

As substituent groups which the ring formed by Z in General Formula (M-I) and that formed by $Z_1$ in General Formula (M-VIII) can have and as what is represented by $R_2$ through $R_8$ in General Formulas (M-II) through (M-VI), the presence of what is represented by the following General Formula (M-IX) is preferable.

$$-R^1-SO_2-R^2$$

General Formula (M-IX)

(here $R^1$ represents an alkylene group, and $R^2$ represents an alkyl group, a cycloalkyl group, or an aryl group).

As an alkylene group represented by $R^1$, it is preferable to have one with a carbon number of 2 or more in the straight chain portion and more preferable one with a carbon number of 3 to 6 which may be of the straight chain type or the branched chain type.

As an alkyl group which $R_2$ may represent the presence of one of a 5- or 6-membered ring is desirable.

In the case of forming positive images, it is most desirable for the substituent group R or $R_1$ on the heterocyclic ring to be one reprsented by General Formula (M-X)

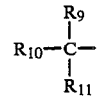

General Formula (M-X)

wherein $R_9$, $R_{10}$, and $R_{11}$ have each the same meanings as R hereinbefore explained.

Two of the three — $R_9$, $R_{10}$, and $R_{11}$ — may join to form a saturated or unsaturated ring (for example, cycloalkane, cycloalkene, or heterocycle between $R_9$ and $R_{10}$), to whose ring $R_{11}$ may furthermore be bonded to form a bridged hydrocarbon compound residue.

The magenta couplers referred to above, are, preferably, compounds Nos. 1 through 77 described on pages 15 through 31 in Japanese patent application Ser. No. 220060/1987.

In the practice of this invention, a magenta coupler employed in accordance with the description above is ordinarily used in a quantity in the range of 0.05 to 2.0 mols per mol of silver in the photosensitive silver halide emulsion layer.

In the practice of this invention, various DTR compounds, yellow coupler, cyan coupler, and the like can be used besides the magenta couplers.

The photosensitive material prepared according to this invention can contain various photographic additives, such as the additives described in Research Disclosure No. 17643, namely, antifogging agent, stabilizer, ultraviolet ray absorbent, antistain agent, fluorescent whitening agent, antifading agent for color images, antistatic agent, hardener, surface-active agent, plasticizer, wetting agent, and the like.

For the hydrophilic colloid for forming emulsions in a photosensitive material of this invention the use of gelatin is desirable and in addition discretionary use may be made of, for example, one or more synthetic hydrophilic high polymers comprising one or more or a copolymer from among a gelatin derivative, a graft polymer of gelatin and a different high polymer, a protein product such as albumin or casein, a cellulose derivative such as a hydroxyethyl cellulose derivative or carboxymethylcellulose, a starch derivative, polyvinyl alcohol, polyvinyl imidazole, polyacrylamide, and the like.

As the support of a photosensitive material of this invention use can be made of baryta paper, polyethylene-coated paper, polypropylene-based syntheric paper, transparent support functioning also as a reflective layer such as a glass plate, cellulose acetate, or cellulose nitrate, polyester film such as polyethylene terephthalate film, polyamide film, polycarbonate film, polystyreene film, or the like; ordinary transparent support also serves the purpose. The material for the support is selected from such materials according to the use of the photosensitive material.

To the formation of silver halide emulsion layers and other photographic structural layers of a photosensitive material of this invention various coating methods are applicable, including the dipping coating, air doctor coating, curtain coating, and hopper coating; applicable also is the method of forming two or more layers by simultaneous coating which is described in the disclosure of U.S. Pat. Nos. 2,761,791 and 2,941,898.

In a photosensitive material of this invention the emulsion layers may be laid one over another in a discretionary order. For example, in the case where a full color printing paper is formed, it is desirable that the silver halide emulsion layers are laid in the order of blue-sensitive layer, green-sensitive layer, and red-sensitive layer from the support. It is practical also for the respective color-sensitive silver halide emulsion coating to be formed of two or more layers.

A photosensitive material of this invention can be provided with one or more intermediate layers of suitable thickness according to the use of the product. The material can furthermore be provided with various structural layers, such as a filter layer, anticurl layer, protective layer, and antihalation layer, in a suitable combination. As a binding agent in such structural layers, use can be made of a hydrophilic colloid such as those described above as useful for emulsion layers. The structural layers also can contain various photographic additives which may be used in emulsion layers as mentioned hereinbefore.

The photographic processing method of this invention permits this invention to be applied to any kind of photosensitive material insofar as the material is of the so-called internally developing type, that is to say, the material contains a coupler in itself, thus the applicability of the invention extending to color paper, color negative film, color positive film, reversal color film-slide, reversal color movie film, reversal color TV film, reversal color paper, and the like.

EXAMPLES

The present invention will now be explained in more detail with reference to specific examples, to which the scope of this invention is not to be limited, however.

EXAMPLE 1

A photosensitive material was prepared by coating a support of polyethylene-coated paper to form thereon the undermentioned layers in sequence from the support.

The polyethylene-coated paper was consisted of a sheet of wood free quality paper with a weight of 165 g/m$^2$ having on its surface a coating layer with a thickness of 0.035 mm which was formed from a mixture of 200 parts by weight of polyethylene with a average molecular weight of 100,000 and a density of 0.95 and 20 parts by weight of polyethylene with an average molecular weight of 2,000 and a density of 0.80 containing 6.5 wt.% of anatase-type titanium dioxide therewith by a technique of extrusion coating; the underside of said sheet of wood free paper had a coating of only polyethylene with a thickness of 0.040 mm. The undermentioned layers were laid in sequence on the support after pretreatment of the polyethylene coated on the surface of the support by corona discharge thereon.

First Layer

This layer is a blue-sensitive silver halide emulsion layer comprising a silver chloro-bromide emulsion containing 0.5 mol% of silver bromide; the emulsion layer containing gelatin in a quantity of 340 g per mol of silver halide, a sensitizing dye with the structure (III) illustrated below in a quantity of $2.4\times10^{-4}$ mol per mol of silver halide (isopropyl alcohol was used as a solvent), 200 mg/m$^2$ of 2,5-di-t-butylhydroquinone dissolved and dispersed in dibutylphthalate and a yellow coupler with the structure (Y-1) illustrated below in a quantity of $2.1\times10^{-1}$ mol per mol of silver halide was coated to be 290 mg/m$^2$ of silver.

Second Layer

This layer was formed as follows:

A composition containing 290 mg/m$^2$ of di-t-octylhydroquinone which was dissolved and dispersed in dibutylphthalate and as an ultraviolet ray absorbent 200 mg/m$^2$ of a mixture (1:1:1:1) of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole, and
2-(2'-hydroxy-3',5'-di-t-butylphenyl)-5-chloro-benzotriazole
was coated to be in a quantity of 2,000 mg/m2 of gelatin.

Third Layer

This layer is a green-sensitive silver halide emulsion layer comprising a silver chloro-bromide emulsion containing 0.4 mol% of silver bromide; the emulsion layer containing gelatin in a quantity of 460 g per mol of silver halide, a sensitizing dye with structure (I) illustrated below in a quantity of $2.5\times10^{-4}$ mol per mol of silver halide, 2,5-di-t-butylhydroquinone dissolved in a solvent composed of dibutylphthalate and tricresylphosphate in the ratio 2:1 and a magenta coupler with the structure (M-I) illustrated below in a quantity of $1.5\times10^{-1}$ mol per mol of silver halide was coated to be 240 mg/m$^2$ of silver. Furthermore, 2,2,4-trimethyl-6-lauryloxy-7-t-octylchroman was added as an antioxidant in a quantity of 0.30 mol per mol of the coupler.

Fourth Layer

This layer is a gelatin layer comprising 30 mg/m$^2$ of di-t-octylhydroquinone dissolved and dispersed in dioctylphthalate and as an ultraviolet ray absorbent 500 mg/m$^2$ of a mixture (2 : 1.5 : 1.5 : 2) of
2-(2'-hydroxy-3',5'-di-t-butylphenyl)benzotriazole,
2-(2'-hydroxy-5'-t-butylphenyl)benzotriazole,
2-(2'-hydroxy-3'-t-butyl-5'-methylphenyl)-5-chlorobenzotriazole, and
2-(2'-hydroxy-3',5'-di-t-butylphenyl)-5-chloro-benzotriazole.
The layer was coated to be 1900 mg/m$^2$ of gelatin.

Fifth Layer

This layer is a red-sensitive silver halide emulsion layer comprising a silver chloro-bromide emulsion containing 0.4 mol% of silver bromide; the emulsion layer containing gelatin in a quantity of 500 g per mol of silver halide, a sensitizing dye with the structure (II) illustrated below in a quantity of $2.5\times10^{-5}$ mol per mol of silver halide, 150 mg/m$^2$ of 2,5-di-t-butylhydroquinone dissolved and dispersed in dibutylphthalate and a cyan coupler with the structure (C-1) illustrated below in a quantity of $3.5\times10^{-1}$ mol per mol of silver halide was coated to be 290 mg/m$^2$ of silver halide.

Sixth Layer

This layer is a gelatin layer which was coated in a quantity of 1,000 mg/m$^2$ of gelatin.

The silver halide emulsion in each of the photosensitive emulsion layers (first, third, and fifth layers) was prepared by the method described in Japanese Patent Examined Publication No. 7772/1971 and was chemically sensitized with 5 hydrate of sodium thiosulfate, and comprised of 4-hydroxy-6-methyl-1,3,3a,7-tetrazaindene as a stabilizing agent (2.5 g per mol of the silver halide), bis(vinylsulfonylmethyl)ether as a hardener (10 mg per gram of the gelatin), and saponin as a coating auxiliary.

To the second layer were added the exemplary compounds represented by General Formulas (AI-I) through (AI-IV) and the compounds for comparison (AI-1) and (AI-2) illustrated below each in a quantity of 15 mg/m$^2$, as shown in Table 1.

Sensitizing dye (I)

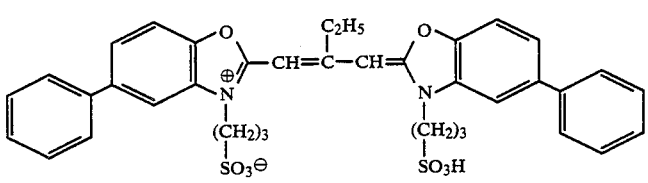

Sensitizing dye (II)

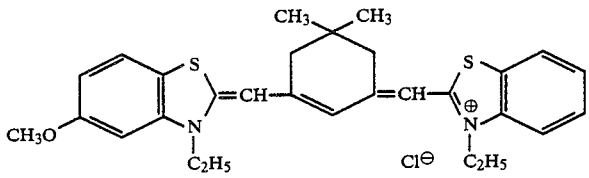

Sensitizing dye (III)

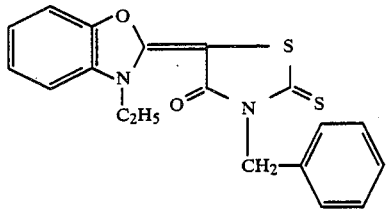

(AI-1)

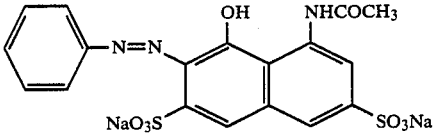

-continued (AI-2)

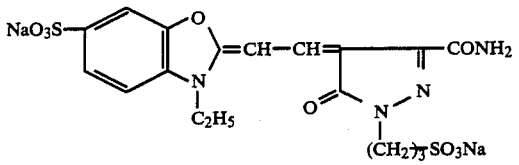

(Y-1)

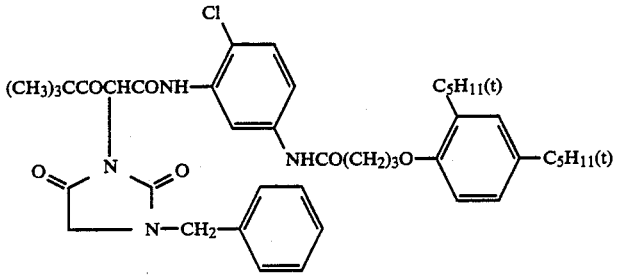

(M-1)

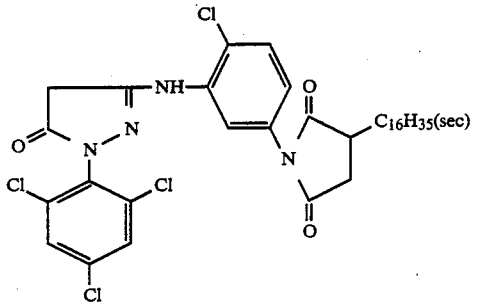

(C-1)

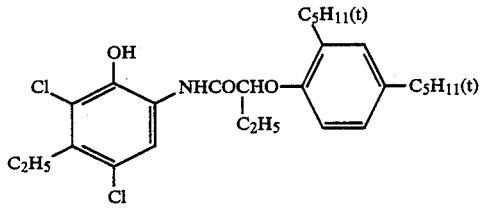

Color paper samples prepared as described above were subjected to exposure and processed by the following procedure and by the use of the undermentioned treating solutions.

| Processing Procedure (one vessel for each step) | | |
|---|---|---|
| (1) Color developing | 38° C. | 20 sec. |
| (2) Bleach-fixing | 35° C. | 20 sec. |
| (3) Stabilizing | 35° C. | See Table 1 |
| (4) Drying | 60° C.-80° C. | 30° C. |

| [Color Developing Tank Liquid] | |
|---|---|
| Benzyl alcohol | 2 g |
| Diethylene glycol | 10 g |
| Potassium bromide | 0.01 g |
| Potassium chloride | 2.3 g |
| Potassium sulfite (50% solution) | 0.5 ml |
| Color developing agent (3-methyl-4-amino-N-ethyl-N-(β-methanesulfonamidoethyl)-aniline sulfate | 5.0 g |
| Diethylhydroxylamine (85%) | 5.0 g |
| Triethanolamine | 10.0 g |
| Potassium carbonate | 30 g |
| Sodium ethylenediaminetetra acetate | 2.0 g |
| Fluorescent whitening agent (PK-Conc, product of Nippon Soda) | 2.0 g |

Water is added to make the total quantity 1l and the pH is adjusted to 10.15 with potassium hydroxide or sulfuric acid.

| [Color Developing Replenisher] | |
|---|---|
| Benzyl alcohol | 3 g |
| Diethylene glycol | 10 g |
| Potassium chloride | 3.0 g |
| Potassium sulfite (50% solution) | 1.5 ml |
| Color developing agent (3-methyl-4-amino-N-ethyl-N-(β-methanesulfonamidoethyl)-aniline sulfate | 8.0 g |
| Diethylhydroxylamine (85%) | 7.0 g |
| Triethanolamine | 10.0 g |
| Potassium carbonate | 30 g |
| Sodium ethylenediaminetetra acetate | 2.0 g |
| Fluorescent whitening agent (PK-Conc, product of Nippon Soda) | 2.5 g |

Water is added to make the total quantity 1l and the pH is adjusted to 10.40 with potassium hydroxide or sulfuric acid.

| [Bleach-Fixing Tank Liquid and Replenisher] | |
|---|---|
| Diethylenetriaminepentaacetic acid ferric ammonium salt | 65.0 g |
| Diethylenetriamine pentaacetic acid | 3.0 g |
| Ammonium thiosulfate (70% solution) | 100.0 ml |
| 5-amino-1,3,4-thiadizaole-2-thiol | 0.5 g |

-continued

| [Bleach-Fixing Tank Liquid and Replenisher] | |
|---|---|
| Ammonium sulfite (40% solution) | 27.5 ml |

While the pH is adjusted to 6.50 with ammonia water or glacial acetic acid, water is added to make the total quantity 1l.

| [Stabilizing Tank Liquid and Replesnisher] | |
|---|---|
| Orthophenylphenol | 1.0 g |
| 5-chloro-2-methyl-4-isothiazolin-3-one | 0.02 g |
| 2-methyl-4-isothiazolin-3-one | 0.02 g |
| Ethylene glycol | 1.0 g |
| Cinopal SFP (product of Chiba-Geigy) | 2 g |
| 1-hydroxyethylidene-1,1-diphosphonate (60% aqueous solution) | 3.0 g |
| $BiCl_3$ (45% aqueous solution) | 0.65 g |
| $MgSO_4.7H_2O$ | 0.2 g |
| PVP (polyvinylpyrrolidone) | 1.0 g |
| Soluble iron salt (See Table 1) | See Table 1 |
| Ammonia water (ammonium hydroxide 25% aqueous solution) | 2.5 g |
| Nitrilotriacetic acid.3 sodium salt | 1.5 g |

Water is added to make the total quantity 1l and the pH is adjusted to 7.5 with ammonia water and sulfuric acid.

With respect to each sample of the color paper processed, the spectral reflection density of the unexposed white ground at 420 nm was measured by a photoelectric densitometer. Then, the light-exposed portion was also examined for blueing by visual observation. The results are shown in Table 1.

ric ammonium ethylenediaminetetra acetate, DTPA.Fe represents ferric ammonium diethylenetriamine pentaacetate, Cit.Fe represents ferric ammonium citrate, and HTA.Fe represents ferric ammonium nitrilotri acetate.

In the Table, o means that blueing was not observed; Δ means that blueing was somewhat observed; x means that blueing was so conspicuous as to even lower the commercial value of the product; blueing was remarkable in proportion to the number of x's.

Table 1 shows that even by rapid processing, the results are favorable with respect to staining of unexposed portions, the white ground property, and blueing of light-exposed portions, provided that soluble iron salts specified by this invention are used in the stabilizing bath in a specified concentration, that the treating time is less than 30 seconds, and that the compounds represented by General Formulas (AI-I) through (AI-IV) are used in the photosensitive material; it has become obvious that a lack in any one of these conditions makes the expected effect of the invention unattainable.

EXAMPLE 2

Samples of the same color paper as in Example 1 were subjected to running treatment by the use of the same treating solutions as in Example 1.

For the running treatment, an automatic developing machine was filled with said color developing tank liquid and the respective vessels for the bleach-fixing and stabilizing with the necessary liquids, and said color paper samples were processed by replenishment of the color developing bath, bleach-fixing bath, and stabilizing bath at intervals of 3 minutes with the replenishers

TABLE 1

| Experiment No. | Stabilizing bath: Soluble iron salt | Stabilizing bath: Addition (mol/l) | Stabilizing bath: Treating time (sec.) | Photosensitive material AI Dye | Stain density at unexposed portion (420 nm) | Blueing at light-exposed portion | Remarks |
|---|---|---|---|---|---|---|---|
| 1-1 | Not added | Not added | 20 | Exemplary compound (II-20) | 0.086 | xx | Comp. |
| 1-2 | EDTA.Fe | $1 \times 10^{-3}$ | 20 | Exemplary compound (II-20) | 0.077 | x | Comp. |
| 1-3 | EDTA.Fe | $3 \times 10^{-3}$ | 20 | Exemplary compound (II-20) | 0.075 | x | Comp. |
| 1-4 | EDTA.Fe | $5 \times 10^{-3}$ | 20 | Exemplary compound (II-20) | 0.041 | Δ | Inv. |
| 1-5 | EDTA.Fe | $8 \times 10^{-3}$ | 20 | Exemplary compound (II-20) | 0.038 | o | Inv. |
| 1-6 | EDTA.Fe | $12 \times 10^{-3}$ | 20 | Exemplary compound (II-20) | 0.031 | o | Inv. |
| 1-7 | EDTA.Fe | $20 \times 10^{-3}$ | 20 | Exemplary compound (II-20) | 0.032 | o | Inv. |
| 1-8 | EDTA.Fe | $50 \times 10^{-3}$ | 20 | Exemplary compound (II-20) | 0.031 | o | Inv. |
| 1-9 | EDTA.Fe | $100 \times 10^{-3}$ | 20 | Exemplary compound (II-20) | 0.031 | o | Inv. |
| 1-10 | EDTA.Fe | $150 \times 10^{-3}$ | 20 | Exemplary compound (II-20) | 0.037 | o | Inv. |
| 1-11 | HEDP.Fe | $20 \times 10^{-3}$ | 20 | Exemplary compound (II-20) | 0.025 | o | Inv. |
| 1-12 | DTPA.Fe | $20 \times 10^{-3}$ | 20 | Exemplary compound (II-20) | 0.030 | o | Inv. |
| 1-13 | Cit.Fe | $20 \times 10^{-3}$ | 20 | Exemplary compound (II-20) | 0.022 | o | Inv. |
| 1-14 | NTA.Fe | $20 \times 10^{-3}$ | 20 | Exemplary compound (II-20) | 0.034 | o | Inv. |
| 1-15 | EDTA.Fe | $20 \times 10^{-3}$ | 3 | Exemplary compound (II-20) | 0.038 | 0 | Inv. |
| 1-16 | EDTA.Fe | $20 \times 10^{-3}$ | 4 | Exemplary compound (II-20) | 0.030 | o | Inv. |
| 1-17 | EDTA.Fe | $20 \times 10^{-3}$ | 6 | Exemplary compound (II-20) | 0.025 | o | Inv. |
| 1-18 | EDTA.Fe | $20 \times 10^{-3}$ | 10 | Exemplary compound (II-20) | 0.025 | o | Inv. |
| 1-19 | EDTA.Fe | $20 \times 10^{-3}$ | 15 | Exemplary compound (II-20) | 0.026 | o | Inv. |
| 1-20 | EDTA.Fe | $20 \times 10^{-3}$ | 20 | Exemplary compound (II-20) | 0.032 | o | Inv. |
| 1-21 | EDTA.Fe | $20 \times 10^{-3}$ | 25 | Exemplary compound (II-20) | 0.036 | o | Inv. |
| 1-22 | EDTA.Fe | $20 \times 10^{-3}$ | 30 | Exemplary compound (II-20) | 0.037 | o | Inv. |
| 1-23 | EDTA.Fe | $20 \times 10^{-3}$ | 40 | Exemplary compound (II-20) | 0.038 | x | Comp. |
| 1-24 | EDTA.Fe | $20 \times 10^{-3}$ | 60 | Exemplary compound (II-20) | 0.038 | x | Comp. |
| 1-25 | EDTA.Fe | $20 \times 10^{-3}$ | 90 | Exemplary compound (II-20) | 0.038 | xx | Comp. |
| 1-26 | EDTA.Fe | $20 \times 10^{-3}$ | 20 | Not added | 0.029 | x | Comp. |
| 1-27 | EDTA.Fe | $20 \times 10^{-3}$ | 20 | AI-1 | 0.078 | x | Comp. |
| 1-28 | EDTA.Fe | $20 \times 10^{-3}$ | 20 | AI-2 | 0.083 | Δ | Comp. |
| 1-29 | EDTA.Fe | $20 \times 10^{-3}$ | 20 | Exemplary compound (I-1) | 0.030 | o | Inv. |
| 1-30 | EDTA.Fe | $20 \times 10^{-3}$ | 20 | Exemplary compound (II-8) | 0.031 | o | Inv. |
| 1-31 | EDTA.Fe | $20 \times 10^{-3}$ | 20 | Exemplary compound (II-10) | 0.029 | o | Inv. |
| 1-32 | EDTA.Fe | $20 \times 10^{-3}$ | 20 | Exemplary compound (III-3) | 0.030 | o | Inv. |
| 1-33 | EDTA.Fe | $20 \times 10^{-3}$ | 20 | Exemplary compound (IV-8) | 0.028 | o | Inv. |

In the Table, HEDP.Fe represents ferric 1-hydroxyethylidene-1,1-diphosphonate, EDTA.Fe represents fersupplied by bath-control pumps.

The color developing bath was replenished at the rate of 180 ml per $m^2$ of the color paper, the bleach-fixing bath was replenished at the rate of 220 ml per $m^2$, and the stabilizing bath was replenished at the rate of 250 ml per $m^2$.

The stabilizing baths employed was the same as in Experiment No. 1-1 in Example, the stabilizing baths whose treating time was set for 10 seconds, 20 seconds, 30 seconds, 40 seconds, and 60 seconds respectively were employed as shown in Table 2; the other conditions were the same as in Example 1. The running treatment was continued without a break until the quantity of the stabilizing bath replenisher used amounted to three times as large as the liquid capacity of the stabilizing tank. When the running treatment was ended, the stabilizing tank liquid has soluble iron salts in a concentration of $22\times10^{-3}$ mol/l.

Upon ending the running treatment, the stain of the unexposed portions of the processed color paper was measured at 420 nm, and the light-exposed portions of the samples were examined for blueing and the stabilizing bath was examined for the foaming property.

The results are shown in Table 2.

Table 2 is described in the same manner as Table 1 for Example 1. With respect to the foaming property, the symbol (−) means that virtually no foaming was observed, and the symbol (+) means that foaming was observed to some extent; the number of the symbols (++) proportionately indicates the intensity of the foaming.

Table 2 shows that, when the treating time in the stabilizing bath is less than 30 seconds also an AI dye is used according to this invention, satisfactory results are obtainable with respect to staining of unexposed portions, blueing of light-exposed portions, and foaming of the stabilizing bath.

EXAMPLE 3

Example 3 differed from Example 1 only in that the magenta coupler used in Example 1 was replaced by the undermentioned couplers (M-2) through (M-11). The replacement resulted in improvement of the stain density of the unexposed portions by 20 to 30% (at 420 nm).

TABLE 2

| Experiment No. | Stabilizing bath treating time (sec.) | AI Dye | Stain density at unexposed portion | Blueing at light-exposed portion | Forming property | Remarks |
|---|---|---|---|---|---|---|
| 2-1 | 10 | Exemplary compound (II-20) | 0.026 | o | — | Inv. |
| 2-2 | 20 | Exemplary compound (II-20) | 0.029 | o | — | Inv. |
| 2-3 | 30 | Exemplary compound (II-20) | 0.038 | Δ | —+ | Inv. |
| 2-4 | 40 | Exemplary compound (II-20) | 0.039 | x | —+++ | Comp. |
| 2-5 | 20 | Not added | 0.030 | xx | —++ | Comp. |
| 2-6 | 20 | Exemplary compound (I-1) | 0.030 | o | — | Inv. |
| 2-7 | 20 | Exemplary compound (I-4) | 0.031 | o | — | Inv. |
| 2-8 | 20 | Exemplary compound (II-8) | 0.030 | o | — | Inv. |
| 2-9 | 20 | Exemplary compound (II-14) | 0.028 | o | — | Inv. |
| 2-10 | 20 | Exemplary compound (III-3) | 0.029 | o | — | Inv. |
| 2-11 | 20 | Exemplary compound (III-6) | 0.030 | o | — | Inv. |
| 2-12 | 20 | Exemplary compound (IV-4) | 0.032 | o | — | Inv. |
| 2-13 | 20 | Comparison (AI-1) | 0.081 | x | —++ | Comp. |
| 2-14 | 20 | Comparison (AI-2) | 0.082 | x | —++ | Comp. |

(M-2)

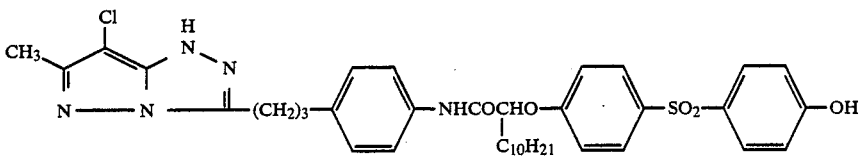

-continued
(M-3)
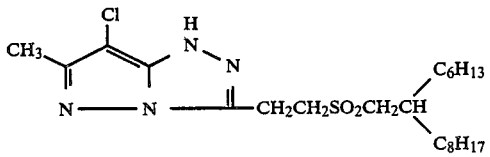
(M-4)
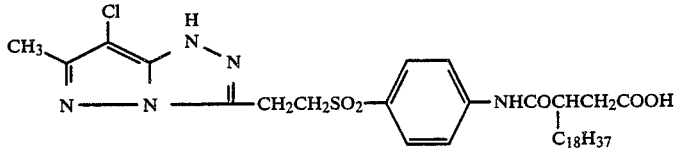
(M-5)
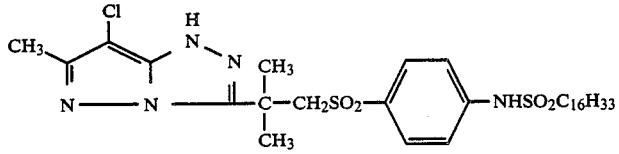
(M-6)
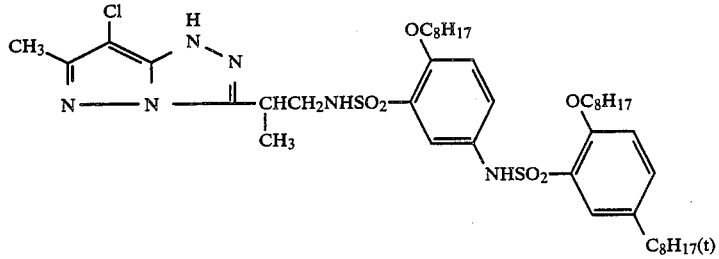
(M-7)
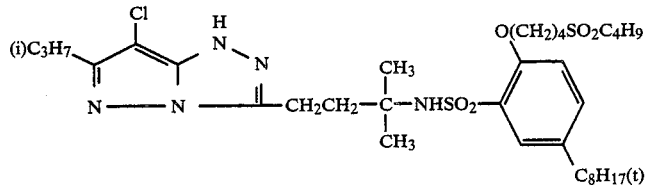
(M-8)
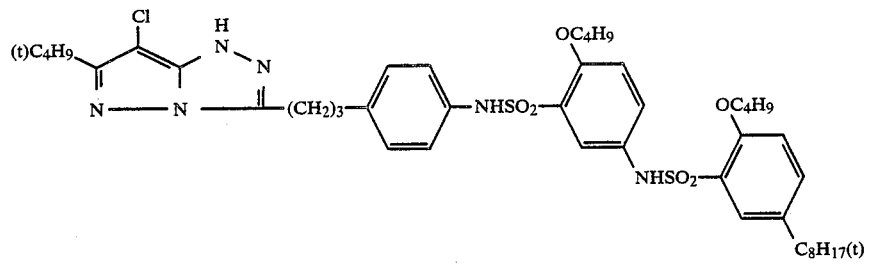
(M-9)
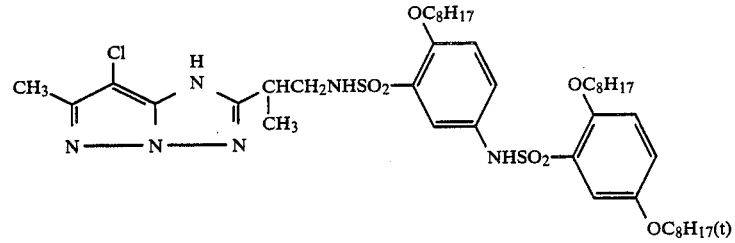
(M-10)
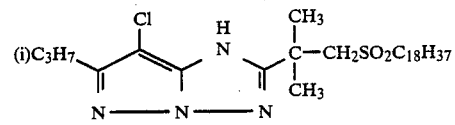

-continued

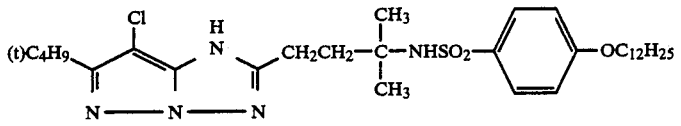

(M-11)

EXAMPLE 4

Samples of photosensitive materials were prepared by coating the support of the same polyethylene-coated paper as in Example 1 with the undermentioned layers in sequence from the support.

First Layer

This layer is a blue-sensitive silver halide emulsion layer comprising a silver chloro-bromide emulsion containing 0.5 mol% of silver bromide; the emulsion layer containing gelatin in a quantity of 340 g per mol of silver halide, a sensitizing dye in Table 3 in a quantity of $2.4\times10^{-4}$ mol per mol of silver halide (isopropyl alcohol was used as a solvent), 200 mg/m$^2$ of 2,5-di-t-butylhydroquinone dissolved and dispersed in dibutylphthalate and a yellow coupler with the structure (Y-1) in a quantity of $2.1\times10^{-1}$ mol per mol of silver halide was coated to be 300 mg/m$^2$ of silver.

Second Layer

This layer was formed as follows:

A composition containing 310 mg/m$^2$ of di-t-octylhydroquinone which was dissolved and dispersed in dibutylphthalate and as an ultraviolet ray absorbent 200 mg/m$^2$ of a mixture (1:1:1:1) of 2-(2'-hydroxy-3',5'-di-t-butylphenyl)benzotriazole,
2-(2'-hydroxy-5'-butylphenyl)benzotriazole,
2-(2'-hydroxy-3'-t-butyl-5'-methylphenyl)-5-chlorobenzotriazole, and
2-(2'-hydroxy-3',5'-di-t-butylphenyl)-5-chloro-benzotriazole was coated to be in a quantity of 2,000 mg/m$^2$ of gelatin.

Third Layer

This layer is a green-sensitive silver halide emulsion layer comprising a silver chloro-bromide emulsion containing 0.5 mol% of silver bromide; the emulsion layer containing gelatin in a quantity of 460 g per mol of silver halide, a sensitizing dye (I) in a quantity of $2.5\times10^{-4}$ mol per mol of silver halide, 2,5-di-t-butylhydroquinone dissolved in a solvent composed of dibutylphthalate and tricresylphosphate in the ratio 2:1 and a magenta coupler (M-I) in a quantity of $1.5\times10^{-1}$ mol per mol of silver halide was coated to be 240 mg/m$^2$ of silver. Furthermore, 2,2,4-trimethyl-6-lauryloxy-7-t-octylchroman was added as an antioxidant in a quantity of 0.30 mol per mol of the coupler.

Fourth Layer

This layer is a gelatin layer comprising 25 mg/m$^2$ of di-t-octylhydroquinone dissolved and dispersed in dioctylphthalate and as an ultraviolet ray absorbent 500 mg/m$^2$ of a mixture (2 : 1.5 : 1.5 : 2) of 2-(2'-hydroxy-3',5'-di-t-butylphenyl)benzotriazole,
2-(2'-hydroxy-5'-t-butylphenyl)benzotriazole,
2-(2'-hydroxy-3'-t-butyl-5'-methylphenyl)-5'-chlorobenzotriazole, and
2-(2'-hydroxy-3',5'-di-t-butylphenyl)-5-chloro-benzotriazole.

The layer was coated to be 2,000 mg/m$^2$ of gelatin.

Fifth Layer

This layer is a red-sensitive silver halide emulsion layer comprising a silver chloro-bromide emulsion containing 0.4 mol% of silver bromide; the emulsion layer containing gelatin in a quantity of 500 g per mol of silver halide, a sensitizing dye (II) in a quantity of $2.5\times10^{-4}$ mol per mol of silver halide, 160 mg/m$^2$ of 2,5-di-t-butylhydroquinone dissolved and dispersed in dibutylphthalate and a cyan coupler (C-1) in a quantity of $3.5\times10^{-1}$ mol per mol of silver halide was coated to be 290 mg/m$^2$ of silver.

Sixth Layer

This layer is a gelatin layer which was coated in a quantity of 1,000 mg/m$^2$ of gelatin.

The silver halide emulsion in each of the photosensitive emulsion layers (first, third, and fifth layers) was prepared by the method described in Japanese Patent Examined Publication No. 7772/1971 and was chemically sensitized with 5 hydrate of sodium thiosulfate, and comprised of 4-hydroxy-6-methyl-l,3,3a,7-tetrazaindene as a stabilizing agent (2.5 g per mol of the silver halide), bis(vinylsulfonylmethyl)ether as a hardener (12 mg per gram of the gelatin), and saponin as a coating auxiliary.

Color paper samples prepared as described above were subjected to exposure and processed by the following procedure and by the use of the undermentioned treating solutions.

| Processing Procedure (one vessel for each step) | | |
|---|---|---|
| (1) Color developing | 38° C. | 20 sec. |
| (2) Bleach-fixing | 35° C. | 20 sec. |
| (3) Stabilizing | 35° C. | See Table 3 |
| (4) Drying | 60° C.–80° C. | 30 sec. |
| [Color Developing Tank Liquid] | | |
| Benzyl alcohol | | 0.5 g |
| Diethylene glycol | | 10 g |
| Potassium bromide | | 0.01 g |
| Potassium chloride | | 2.3 g |
| Potassium sulfite (50% solution) | | 0.5 ml |
| Color developing agent (3-methyl-4-amino-N-ethyl-N-(β-methanesulfonamidoethyl)-aniline sulfate | | 5.0 g |
| Diethylhydroxylamine (85%) | | 5.0 g |
| Triethanolamine | | 10.0 g |
| Potassium carbonate | | 30 g |
| Sodium ethylenediaminetetra acetate | | 2.0 g |
| Fluorescent whitening agent (Keicol PK-Conc, product of Nippon Soda) | | 2.0 g |

Water is added to make the total quantity 1l and the pH is adjusted to 10.15 with potassium hydroxide or sulfuric acid.

| [Color Developing Replenisher] | |
|---|---|
| Benzyl alcohol | 0.5 g |
| Diethylene glycol | 10 g |
| Potassium chloride | 3.0 g |
| Potassium sulfite (50% solution) | 1.5 ml |
| Color developing agent (3-methyl-4-amino-N-ethyl-N-(β-methanesulfonamidoethyl)- | 8.0 g |

-continued

| [Color Developing Replenisher] | |
|---|---|
| aniline sulfate | |
| Diethylhydroxylamine (85%) | 7.0 g |
| Triethanolamine | 10.0 g |
| Potassium carbonate | 30 g |
| Sodium ethylenediaminetetra acetate | 2.0 g |
| Fluorescent whitening agent (Keicol PK-Conc, product of Nippon Soda) | 2.5 g |

Water is added to make the total quantity 1l and the pH is adjusted to 10.40 with potassium hydroxide or sulfuric acid.

| [Bleach-Fixing Tank Liquid and Replenisher] | |
|---|---|
| Diethylenetriamine pentaacetic acid ferric ammonium salt | 65.0 g |
| Diethylenetriamine pentaacetic acid | 3.0 g |
| Ammonium thiosulfate (70% solution) | 100.0 ml |
| 5-amino-1,3,4-thiadizaole-2-thiol | 0.5 g |
| Ammonium sulfite (40% solution) | 27.5 ml |

While the pH is adjusted to 6.50 with ammonia water or glacial acetic acid, water is added to make the total quantity 1l.

| [Stabilizing Tank Liquid and Replenisher] | |
|---|---|
| Orthophenylphenol | 1.0 g |
| 5-chloro-2-methyl-4-isothiazolin-3-one | 0.02 g |
| 2-methyl-4-isothiazolin-3-one | 0.02 g |
| Ethylene glycol | 1.0 g |
| Tinopal SFP (product of Chiba-Geigy) | 2 g |
| 1-hydroxyethylidene-1,1-diphosphonate (60% aqueous solution) | 3.0 g |
| $BiCl_3$ (45% aqueous solution) | 0.65 g |
| $MgSO_4.7H_2O$ | 0.2 g |
| PVP (polyvinylpyrrolidone) | 1.0 g |
| Soluble iron salt (See Table 1) | See Table 3 |
| Ammonia water (ammonium hydroxide 25% aqueous solution) | 2.5 g |
| Nitrilotriacetic acid.3 sodium salt | 1.5 g |

Water is added to make the total quantity 1l and the pH is adjusted to 7.5 with ammonia water and sulfuric acid.

With respect to each sample of the color paper processed, the spectral reflection density of the unexposed white ground at 420 nm was measured by a photoelectric densitometer. Then, the light-exposed portion was also examined for blueing by visual observation. The results are shown in Table 3.

TABLE 3

| Experiment No. | Stabilizing bath: Soluble iron salt | Stabilizing bath: Addition (mol/l) | Stabilizing bath: Treating time (sec.) | Photosensitive material sensitizing dye | Stain density at unexposed portion (420 nm) | Blueing at light-exposed portion | Remarks |
|---|---|---|---|---|---|---|---|
| 3-1 | Not added | Not added | 20 | Exemplary compound (BS-I-2) | 0.071 | xxx | Comp. |
| 3-2 | EDTA.Fe | $1 \times 10^{-3}$ | 20 | Exemplary compound (BS-I-2) | 0.064 | x | Comp. |
| 3-3 | EDTA.Fe | $3 \times 10^{-3}$ | 20 | Exemplary compound (BS-I-2) | 0.056 | x | Comp. |
| 3-4 | EDTA.Fe | $5 \times 10^{-3}$ | 20 | Exemplary compound (BS-I-2) | 0.032 | Δ | Inv. |
| 3-5 | EDTA.Fe | $8 \times 10^{-3}$ | 20 | Exemplary compound (BS-I-2) | 0.030 | o | Inv. |
| 3-6 | EDTA.Fe | $12 \times 10^{-3}$ | 20 | Exemplary compound (BS-I-2) | 0.027 | o | Inv. |
| 3-7 | EDTA.Fe | $20 \times 10^{-3}$ | 20 | Exemplary compound (BS-I-2) | 0.026 | o | Inv. |
| 3-8 | EDTA.Fe | $50 \times 10^{-3}$ | 20 | Exemplary compound (BS-I-2) | 0.025 | o | Inv. |
| 3-9 | EDTA.Fe | $100 \times 10^{-3}$ | 20 | Exemplary compound (BS-I-2) | 0.025 | o | Inv. |
| 3-10 | EDTA.Fe | $150 \times 10^{-3}$ | 20 | Exemplary compound (BS-I-2) | 0.029 | o | Inv. |
| 3-11 | HEDP.Fe | $20 \times 10^{-3}$ | 20 | Exemplary compound (BS-I-2) | 0.020 | o | Inv. |
| 3-12 | DTPA.Fe | $20 \times 10^{-3}$ | 20 | Exemplary compound (BS-I-2) | 0.029 | o | Inv. |
| 3-13 | Cit.Fe | $20 \times 10^{-3}$ | 20 | Exemplary compound (BS-I-2) | 0.019 | o | Inv. |
| 3-14 | NTA.Fe | $20 \times 10^{-3}$ | 20 | Exemplary compound (BS-I-2) | 0.028 | o | Inv. |
| 3-15 | EDTA.Fe | $20 \times 10^{-3}$ | 3 | Exemplary compound (BS-I-2) | 0.029 | o | Inv. |
| 3-16 | EDTA.Fe | $20 \times 10^{-3}$ | 4 | Exemplary compound (BS-I-2) | 0.025 | o | Inv. |
| 3-17 | EDTA.Fe | $20 \times 10^{-3}$ | 6 | Exemplary compound (BS-I-2) | 0.019 | o | Inv. |
| 3-18 | EDTA.Fe | $20 \times 10^{-3}$ | 10 | Exemplary compound (BS-I-2) | 0.019 | o | Inv. |
| 3-19 | EDTA.Fe | $20 \times 10^{-3}$ | 15 | Exemplary compound (BS-I-2) | 0.020 | o | Inv. |
| 3-20 | EDTA.Fe | $20 \times 10^{-3}$ | 20 | Exemplary compound (BS-I-2) | 0.027 | o | Inv. |
| 3-21 | EDTA.Fe | $20 \times 10^{-3}$ | 25 | Exemplary compound (BS-I-2) | 0.029 | o | Inv. |
| 3-22 | EDTA.Fe | $20 \times 10^{-3}$ | 30 | Exemplary compound (BS-I-2) | 0.030 | o | Inv. |
| 3-23 | EDTA.Fe | $20 \times 10^{-3}$ | 40 | Exemplary compound (BS-I-2) | 0.032 | x | Comp. |
| 3-24 | EDTA.Fe | $20 \times 10^{-3}$ | 60 | Exemplary compound (BS-I-2) | 0.032 | x | Comp. |
| 3-25 | EDTA.Fe | $20 \times 10^{-3}$ | 90 | Exemplary compound (BS-I-2) | 0.032 | xx | Comp. |
| 3-26 | EDTA.Fe | $20 \times 10^{-3}$ | 20 | Not added | 0.025 | x | Comp. |
| 3-27 | EDTA.Fe | $20 \times 10^{-3}$ | 20 | Sensitizing dye for comparison (1) | 0.063 | x | Comp. |
| 3-28 | EDTA.Fe | $20 \times 10^{-3}$ | 20 | Sensitizing dye for comparison (2) | 0.069 | Δ | Comp. |
| 3-29 | EDTA.Fe | $20 \times 10^{-3}$ | 20 | Exemplary compound (BS-I-3) | 0.025 | o | Inv. |
| 3-30 | EDTA.Fe | $20 \times 10^{-3}$ | 20 | Exemplary compound (BS-I-6) | 0.022 | o | Inv. |
| 3-31 | EDTA.Fe | $20 \times 10^{-3}$ | 20 | Exemplary compound (BS-I-14) | 0.022 | o | Inv. |
| 3-32 | EDTA.Fe | $20 \times 10^{-3}$ | 20 | Exemplary compound (BS-I-18) | 0.022 | o | Inv. |

TABLE 3-continued

| Experiment No. | Stabilizing bath: Soluble iron salt | Stabilizing bath: Addition (mol/l) | Stabilizing bath: Treating time (sec.) | Photosensitive material sensitizing dye | Stain density at unexposed portion (420 nm) | Blueing at light-exposed portion | Remarks |
|---|---|---|---|---|---|---|---|
| 3-33 | EDTA.Fe | $20 \times 10^{-3}$ | 20 | Exemplary compound (BS-I-5) | 0.024 | o | Inv. |

*Sensitizing dye for comparison (1)

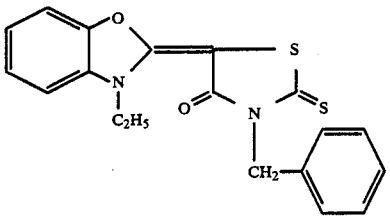

*Sensitizing dye for comparison (2)

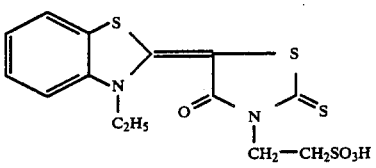

In the Table, HEDP.Fe represents ferric 1-hydroxyethylidene-1,1-diphosphonate, EDTA.Fe represents ferric ammonium ethylenediaminetetra acetate, DTPA.Fe represents ferric ammonium diethylenetriamine pentaacetate, Cit.Fe represents ferric ammonium citrate, and HTA.Fe represents ferric ammonium nitrilotri acetate.

Table 3 shows that even by rapid processing, the results are favorable with respect to staining of unexposed portions, white ground property, and blueing of light-exposed portions, provided that soluble iron salts specified by this invention are used in the stabilizing bath in a specified concentration, that the treating time is less than 30 seconds, and that a compound represented by General Formulas (BS-I) is used in the photosensitive material; it has become obvious that a failure in observing even one of these conditions makes the expected effect of the invention unattainable.

EXAMPLE 5

Samples of the same color paper as in Example 4 were subjected to running treatment by the use of the same treating solutions as in Example 4.

For the running treatment, an automatic developing machine was filled with said color developing tank liquid and the respective vessels for the bleach-fixing and stabilizing with the necessary liquids, and said color paper samples were processed by replenishment of the color developing bath, bleach-fixing bath, and stabilizing bath at intervals of 3 minutes with the respective replenishers supplied by bath-control pumps.

The color developing bath was replenished at the rate of 180 ml per $m^2$ of the color paper, the bleach-fixing bath was replenished at the rate of 220 ml per $m^2$, and the stabilizing bath was replenished at the rate of 250 ml per $m^2$.

The stabilizing bath employed was the same as in Experiment No. 1-1 in Example 4, the stabilizing bath whose treating time was set for 10 seconds, 20 seconds, 30 seconds, 40 seconds, and 60 seconds respectively were employed as shown in Table 4, and the sensitizing dyes as shown in Table 4 were employed in the photosensitive materials; the other conditions were the same as in Example 4. The running treatment was continued without a break until the quantity of the stabilizing bath replenisher used amounted to three times as large as the liquid capacity of the stabilizing tank. When the running treatment was ended, the stabilizing tank liquid had soluble iron salts in a concentration of $22 \times 10^{-3}$ mol/l.

Upon ending the running treatment, the stain of the unexposed portions of the processed color paper was measured at 420 nm, and the light-exposed portions of the samples were examined for blueing and the stabilizing bath was examined for the foaming property.

The results are shown in Table 4.

TABLE 4

| Experiment No. | Stabilizing bath treating time (sec.) | Sensitizing dye | Stain density at unexposed portion | Blueing at light-exposed portion | Forming property | Remarks |
|---|---|---|---|---|---|---|
| 4-1 | 10 | Exemplary compound (BS-I-2) | 0.020 | o | — | Inv. |
| 4-2 | 20 | Exemplary compound (BS-I-2) | 0.025 | o | — | Inv. |
| 4-3 | 30 | Exemplary compound (BS-I-2) | 0.033 | Δ | —+— | Inv. |
| 4-4 | 40 | Exemplary compound (BS-I-2) | 0.052 | x | —+++— | Comp. |
| 4-5 | 20 | Not added | 0.025 | xx | —+— | Comp. |
| 4-6 | 20 | Exemplary compound (BS-I-3) | 0.024 | o | — | Inv. |

TABLE 4-continued

| Experiment No. | Stabilizing bath treating time (sec.) | Sensitizing dye | Stain density at unexposed portion | Blueing at light-exposed portion | Forming property | Remarks |
|---|---|---|---|---|---|---|
| 4-7 | 20 | Exemplary compound (BS-I-6) | 0.026 | o | — | Inv. |
| 4-8 | 20 | Exemplary compound (BS-I-5) | 0.023 | o | — | Inv. |
| 4-9 | 20 | Exemplary compound (BS-I-14) | 0.020 | o | — | Inv. |
| 4-10 | 20 | Exemplary compound (BS-I-18) | 0.024 | o | — | Inv. |
| 4-11 | 20 | Exemplary compound (BS-I-12) | 0.022 | o | — | Inv. |
| 4-12 | 20 | Exemplary compound (BS-I-15) | 0.023 | o | — | Inv. |
| 4-13 | 20 | Sensitizing dye for Comparison (1) | 0.072 | x | —++ | Comp. |
| 4-14 | 20 | Sensitizing dye for Comparison (2) | 0.074 | x | —++ | Comp. |

Table 4 is described in the same manner as Table 3 for Example 4. With respect to the foaming property, the symbol (−) means that virtually to foaming was observed, and the symbol (+) means that foaming was observed to some extent; the number of the symbols (++) proportionately indicates the intensity of the foaming.

Table 4 shows that, when the treating time in the stabilizing bath is less than 30 seconds also a sensitizing dye is used in accordance with the invention, satisfactory results are obtainable with respect to stain at unexposed portions, blueing at light-exposed portions, and foaming of the stabilizing bath.

EXAMPLE 6

Example 6 differed from Example 4 only in that a magenta coupler used in Example 4 was replaced by the couplers (M-2) through (M-11). The replacement resulted in improvement of the stain density of the unexposed portions by 20 to 30% (at 420 nm).

What is claimed is:

1. A method of processing an exposed photosensitive material comprising contacting said photosensitive material with a final processing solution containing a soluble iron salt at a concentration of at least about $5\times10^{-3}$ mol/l for a processing time of not more than 30 seconds; said photosensitive material comprises at least one compound selected from the group consisting of the Formulas (AI-I), (AI-II), (AI-III), (AI-IV) and (BS-I) as follows:

Formula (AI-I)

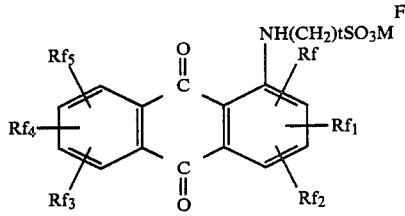

wherein Rf, $Rf_1$, $Rf_2$, $Rf_3$, $Rf_4$ and $Rf_5$ represent a hydrogen atom, a halogen atom, a hydroxy group, an alkyl group, an alkoxy group, a $—SO_3M$ group or a $—NHCH_2SO_3M$ group; t is an integer of 1 to 3; M represents a cation, Formula (AI-II)

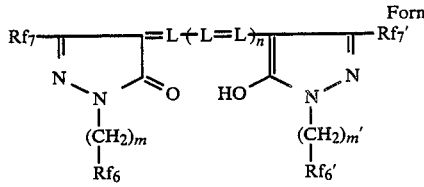

wherein $Rf_6$ and $Rf_6'$ each represent a hydrogen atom, an alkyl group, an alkoxy group, an aryl group or a heterocyclic group; $Rf_7$ and $Rf_7'$ represent a hydroxy group, an alkoxy group, a substituted alkoxy group, a cyano group, a trifluoromethyl group, $—COORf_8$, $—CONHRf_8$, $—NHCORf_8$ (wherein $Rf_8$ represents a hydrogen atom, an alkyl group or an aryl group), an amino group, a substituted amino group having an alkyl group with a carbon number of 1 to 4 or a cyclic amino group represented by

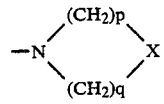

(wherein p and q represent 1 or 2, X represents an oxygen atom, a sulfur atom or a $—CH_2—$ group); L represents a methine group; n represents 0, 1 or 2; m and m' each represent 0 or 1, Formula (AI-III)

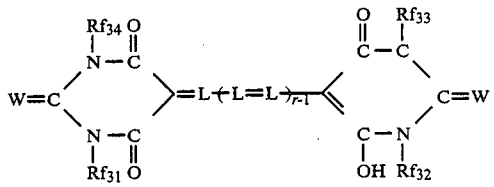

wherein r represents an integer of 1 to 3; W represents an oxygen atom or a sulfur atom; L represents a methine group; $Rf_{31}$ through $Rf_{34}$ each represent a hydrogen atom, an alkyl group, an aryl group, an aralkyl group or a heterocyclic group, provided that at least one of them is a group other than a hydrogen atom, Formula (AI-IV)

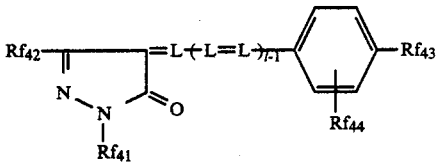

wherein l represents an integer of 1 or 2; L represents a methine group; $Rf_{41}$ represents an alkyl group, an aryl group or a heterocyclic group; $Rf_{42}$ represents a hydroxy group, an alkyl group, an alkoxy group, a substituted alkoxy group, a cyano group, a trifluoromethyl group, —$COORf_8$, —$CONHRf_8$, —$NHCORf_8$ (wherein $Rf_8$ represents a hydrogen atom, an alkyl group or an aryl group), an amino group, a substituted amino group having an alkyl group with a carbon number of 1 to 4 or a cyclic amino group represented by

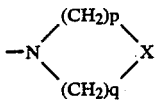

(wherein p and q each represent 1 to 2, X represents an oxygen atom, a sulfur atom or a —$CH_2$— group); $Rf_{43}$ represents a -$OZ_1$ group or a

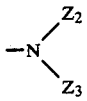

group (wherein $Z_1$, $Z_2$ and $Z_3$ each represent ahydrogen atom or an alkyl group, $Z_2$ and $Z_3$ may be the same as or different from each other or bond together with each other to form a ring); $Rf_{44}$ represents a hydrogen atom, an alkyl group, an alkoxy group or a chlorine atom, Formula (BS-I)

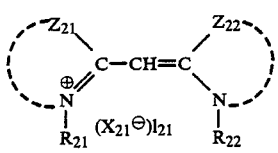

wherein $Z_{21}$ and $Z_{22}$ each represent an atomic group necessary for forming a nucleus of imidazole, oxazole, thiazole, selenazole, pyridine, benzoxazole, benzothiazole, benzoselenazole, benzimidazole, naphthoxazole, naphthothiazole, naphthoselenazole, naphthoimidazole or quinoline; $R_{21}$ and $R_{22}$ each represent a substituted or unsubstituted alkyl group or an alkenyl group; $X_{21}$ represents an anion; and $l_{21}$ represents 0 or 1.

2. The method of claim 1, wherein said processing time of said final processing solution is 3 to 25 seconds.

3. The method of claim 1, wherein said processing time of said final processing solution is 4 to 20 seconds.

4. The method of claim 1, wherein said processing time of said final processing solution is 6 to 15 seconds.

5. The method of claim 1, wherein said concentration of said soluble iron salt in said final processing solution is $8\times10^{-3}$ to $150\times10^{-3}$ mol/l.

6. The method of claim 1, wherein said concentration of said soluble iron salt in said final processing solution is $12\times10^{-3}$ to $100\times10^{-3}$ mol/l.

7. The method of claim 1, wherein said final processing solution is a stabilizing solution, and its replenisher is added to the stabilizing solution at a quantity of not more than 2l per $m^2$ of a photosensitive material.

8. The method of claim 1, wherein said final processing solution is a stabilizing solution, and its replenisher is added to the stabilizing solution at a quantity of not more than 1l per $m^2$ of a photosensitive material.

9. The method of claim 1, wherein said final processing solution is a stabilizing solution, and its replenisher is added to the stabilizing solution at a quantity of not more than 500 ml per $m^2$ of a photosensitive material.

10. The method of claim 1, wherein said final solution contains a chelating agent of which complex with iron ion has 8 or more of a chelate stability constant.

11. The method of claim 10, wherein said chelating agent is selected from the group consisting of an organic carboxylic acid, an organic phosphoric acid, an inorganic phosphoric acid and polyhydroxy compound.

12. The method of claim 10, wherein said iron ion is a ferric ion.

13. The method of claim 1, wherein the content of at least one compound selected from the group consisting of compounds represented by Formulas (AI-I), (AI-II), (AI-III) and (AI-IV) in the photosensitive material is 1 to 800 mg per $m^2$ of the material.

14. The method of claim 1, wherein the content of a compound represented by Formula (BS-I) in the photosensitive material is $5\times10^{-5}$ to $2\times10^{-3}$ mol per mol of silver halide.

15. The method of claim 1, wherein said photosensitive material contains a magenta coupler represented by Formula (M-I);

Formula (M-I)

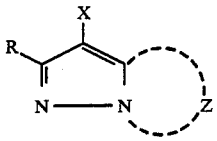

wherein Z represents a group of a nonmetalic atom necessary for forming a nitrogen-containing heterocycle which may have a substituent; X represents a hydrogen atom or a group capable of splitting off by reaction with an oxidized product of a color developing agent; R represents a hydrogen atom or a substituent.

16. The method of claim 15, wherein said R represents an alkyl group, an aryl group, an anilino group, an acylamino group, a sulfonamido group, an alkylthio group, an arylthio group, an alkenyl group, a cycloaklyl group, a cycloalkenyl, a halogen atom, an alkinyl group, a heterocycle, a sulfonyl group, a sulfinyl group, a phosphonyl group, an acyl group, a carbamoyl group, a sulfamoyl group, a cyano group, an alkoxy group, an arayloxy group, a heterocyclicoxy group, a siloxy group, an acyloxy group, a carbamoyloxy group, an amino group, an imido group, a ureido group, a sulfamoylamino group, an alkoxycalbamoylamino group, an arylcarbamoylamino group, an alkoxycarbonyl group, an aryloxycarbonyl group, an alkoxycarbonyl group, a aryloxycarbonyl group, a heteroxyxlicthio group, a spyro-compound residue or a bridged hydrocarbon compound residue.

17. The method of claim 15, wherein said R represents an alkyl group having 1 to 32 of a carbon number, which may be straight-chained or branched.

18. The method of claim 15, wherein said (M-I) represents a compound selected from the group consisting of a compound represented by Formula (M-II), (M-III), (M-IV), (M-V), (M-VI) or (M-VII);

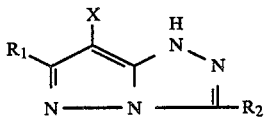
Formula (M-II)

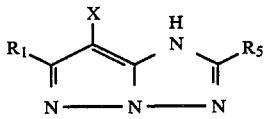
Formula (M-III)

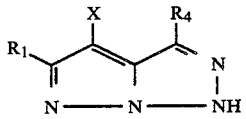
Formula (M-IV)

-continued

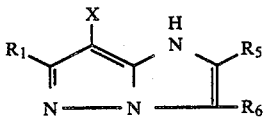
Formula (M-V)

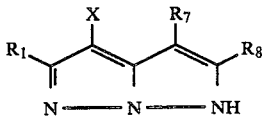
Formula (M-VI)

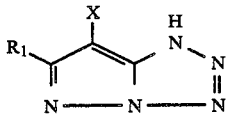
Formula (M-VII)

wherein $R_1$ through $R_8$ represent a hydrogen atom or a substituent; X represents a hydrogen atom or a group capable of splitting off by reaction with an oxidized product of a color developing agent.

19. The method of claim 1, wherein said final solution contains a sulfite and the content of said sulfite is at least $1\times10^{-3}$ mole/l.

20. The method of claim 1, wherein said final solution contains an ammonium compound.

21. The method of claim 20, wherein the content of said ammonium compound is 0.001 to 1.0 mole/l.

22. The method of claim 1, wherein the pH of said final solution is in a range of 3.5 to 9.0.

* * * * *

UNITED STATES PATENT AND TRADEMARK OFFICE

CERTIFICATE OF CORRECTION

PATENT NO. : 4,980,272

DATED : December 25, 1990

INVENTOR(S) : Satoru Kuse et al

It is certified that error appears in the above-identified patent and that said Letters Patent is hereby corrected as shown below:

Claim 1, Column 52, in Formula (AI-III) on the right side, " $\cdots C(=O)-C(Rf_{33})\cdots$ " should be -- $\cdots C(=O)-N(Rf_{33})\cdots$ --;

Claim 1, column 52, lines 40-41, "ahydrogen" should be --a hydrogen--.

Claim 16, column 54, line 63, "araloxy" should be --aryloxy--.

Claim 16, column 55, line 1, "heteroxyxlicthio" should be --heterocyclicthio--.

Signed and Sealed this

Twenty-third Day of March, 1993

*Attest:*

STEPHEN G. KUNIN

*Attesting Officer*

*Acting Commissioner of Patents and Trademarks*